US012653332B1

(12) United States Patent
Justice et al.

(10) Patent No.: US 12,653,332 B1
(45) Date of Patent: Jun. 16, 2026

(54) HIGH-DENSITY ITEM DISPLAY APPARATUS

(71) Applicant: Amazon Technologies, Inc., Seattle, WA (US)

(72) Inventors: Gregory Kim Justice, Bremerton, WA (US); Dominic Misja, Austin, TX (US); Daniel Tyler Matthews, Spring Hill, TN (US); Joseph Mascari, Georgetown, TX (US); Aniruddha Babaji Khadye, San Jose, CA (US); Ryan Q Long, Lynnwood, WA (US); Graham Cyril Jordan, Edmonds, WA (US); Maple Leung, Seattle, WA (US); Paul Mark Michalczuk, Bainbridge Island, WA (US); Robert M Riggs, Winthrop, WA (US); Cody Ryder Volk, Seattle, WA (US); Harry Grewal, Perrysburg, OH (US); Luis Manuel Acevez Arnaut, Seattle, WA (US); Nir Charny, North Grafton, MA (US)

(73) Assignee: Amazon Technologies, Inc., Seattle, WA (US)

( * ) Notice: Subject to any disclaimer, the term of this patent is extended or adjusted under 35 U.S.C. 154(b) by 182 days.

(21) Appl. No.: 18/533,843

(22) Filed: Dec. 8, 2023

(51) Int. Cl.
*A47F 7/14* (2006.01)
*A47F 10/00* (2006.01)

(52) U.S. Cl.
CPC ..... *A47F 10/00* (2013.01); *A47F 7/147* (2013.01); *A47F 2010/005* (2013.01)

(58) Field of Classification Search
CPC .... G01G 19/42; A47F 2010/025; A47F 7/147
See application file for complete search history.

(56) References Cited

U.S. PATENT DOCUMENTS

| | | | | |
|---|---|---|---|---|
| 9,275,361 | B2 * | 3/2016 | Meyer | G06Q 10/087 |
| 10,121,121 | B1 * | 11/2018 | De Bonet | A47B 57/34 |
| 10,466,095 | B1 * | 11/2019 | O'Neill | G01G 19/42 |
| 10,732,026 | B1 * | 8/2020 | Danenberg | H05K 5/0073 |
| 10,746,589 | B1 * | 8/2020 | Danenberg | H05K 5/0073 |
| 10,809,122 | B1 | 10/2020 | Danenberg et al. | |
| 11,002,589 | B1 * | 5/2021 | Zhang | G01G 19/14 |
| 11,085,809 | B1 * | 8/2021 | Franklin | G01G 3/1402 |
| 11,125,607 | B1 | 9/2021 | Justice et al. | |
| 11,157,886 | B2 * | 10/2021 | Winsor | G06K 7/10297 |
| 11,160,369 | B2 * | 11/2021 | Marriott | A47F 5/005 |
| 11,315,074 | B2 * | 4/2022 | Neubarth | G06Q 90/20 |
| 11,326,934 | B1 * | 5/2022 | Munger | G01G 19/4144 |

(Continued)

*Primary Examiner* — Bradley Duckworth
(74) *Attorney, Agent, or Firm* — Athorus, PLLC

(57) ABSTRACT

Described is a high-density item display apparatus and system that enables the vertical presentation of items of one or more different item types. The disclosed high-density item display apparatus may include one or more rows and each row may be configured to support a bin that may hold one or more items of an item type. In some examples, each row of the high-density item display apparatus may be configured to support one or more bins, each bin corresponding to an individually addressable load cell and corresponding bin mounting component. When a bin is mounted to a bin mounting component that is coupled to a load cell a one-to-one connection between the bin and the load cell to which the bin mounting component is coupled is established.

20 Claims, 14 Drawing Sheets

(56) References Cited

U.S. PATENT DOCUMENTS

| | | | | |
|---|---|---|---|---|
| 11,501,454 | B2 * | 11/2022 | Mirza | G07G 1/0036 |
| 11,707,338 | B2 * | 7/2023 | Grimsley | G01G 19/4144 177/144 |
| 11,766,140 | B1 * | 9/2023 | Justice | A47F 5/08 177/199 |
| 11,796,378 | B1 * | 10/2023 | Riggs | G01G 19/42 |
| 11,922,386 | B2 * | 3/2024 | Sasidharakurup | G06Q 20/203 |
| 11,927,472 | B1 * | 3/2024 | DesJardien | G01G 23/007 |
| 11,971,293 | B2 * | 4/2024 | Trakhimovich | G06Q 10/087 |
| 12,059,073 | B1 * | 8/2024 | Justice | A47F 5/0815 |
| 12,118,507 | B2 * | 10/2024 | Chila | G01G 19/4144 |

* cited by examiner

HIGH-DENSITY ITEM DISPLAY APPARATUS

BACKGROUND

Many items, such as magazines, greeting cards, candy bars, gum, breath mints, etc., are often vertically positioned in a stacked or cascading arrangement on a high-density structure and those high-density structures are often in tightly confined areas of a facility, such as near check-out stands, entrances, exits, end-caps, etc. In traditional settings, in which a customer picks an item and then has the item scanned and paid for at a check-out station, such high-density structures work well. However, in the more recent automated or self-service facilities that are partially or completely monitored with imaging elements (e.g., cameras), it is often difficult to accurately monitor these vertically oriented, high-density structures and accurately detect item picks of items. In particular, imaging elements positioned within a facility often do not have a clear view of the item being picked. For example, other items in the high-density area and/or the customer may partially or completely block the view of an imaging element that is intended to detect item picks of items.

DETAILED DESCRIPTION

As is set forth in greater detail below, implementations of the present disclosure are directed to a high-density item display apparatus that enables the vertical presentation of items of one or more different item types. The disclosed high-density item display apparatus may include one or more rows and each row may be configured to support a vertically oriented and detachable bin that may hold one or more items of an item type in a substantially vertical orientation. In some examples, each row of the high-density item display apparatus may be configured to support one or more bins, each bin corresponding to an individually addressable load cell and corresponding bin mounting component. Likewise, each detachable bin that may be mounted to a bin mounting component of the high-density item display apparatus may be the same or different. Still further, any number of rows, each row with any number of bin mounting components and corresponding load cells may be included in a high-density item display apparatus in accordance with the disclosed implementations. As discussed, with the disclosed high-density item display apparatus, when a bin is mounted to a bin mounting component that is coupled to a load cell a one-to-one connection between the bin and the load cell to which the bin mounting component is coupled is established.

Also, as discussed further below, each load cell of the high-density item display apparatus may be coupled to and communicate with a device, such as a printed circuit board assembly ("PCBA") and each load cell may be assigned a defined position within the high-density item display apparatus. Upon detection of a change in weight by a load cell, the load cell may send a communication to the PCBA indicating the detected change in weight and the PCBA may associate an assigned position or load cell identifier corresponding to the load cell with the received communication. Because each individually addressable load cell has a one-to-one connection with a bin, the load cell position or identifier and detected weight change may be used to determine an item pick of an item that is associated with a bin attached to the identified load cell, thereby allowing accurate item pick detection of an item from the high-density item display apparatus without the need for visual detection (e.g., from an imaging element) of the item pick. In some implementations, the determined item and the corresponding item pick, determined in accordance with the disclosed implementations, may be combined with data from other systems of a materials handling facility, such as a vision system to associate the item pick with a customer that picked the item.

Figure 1A:
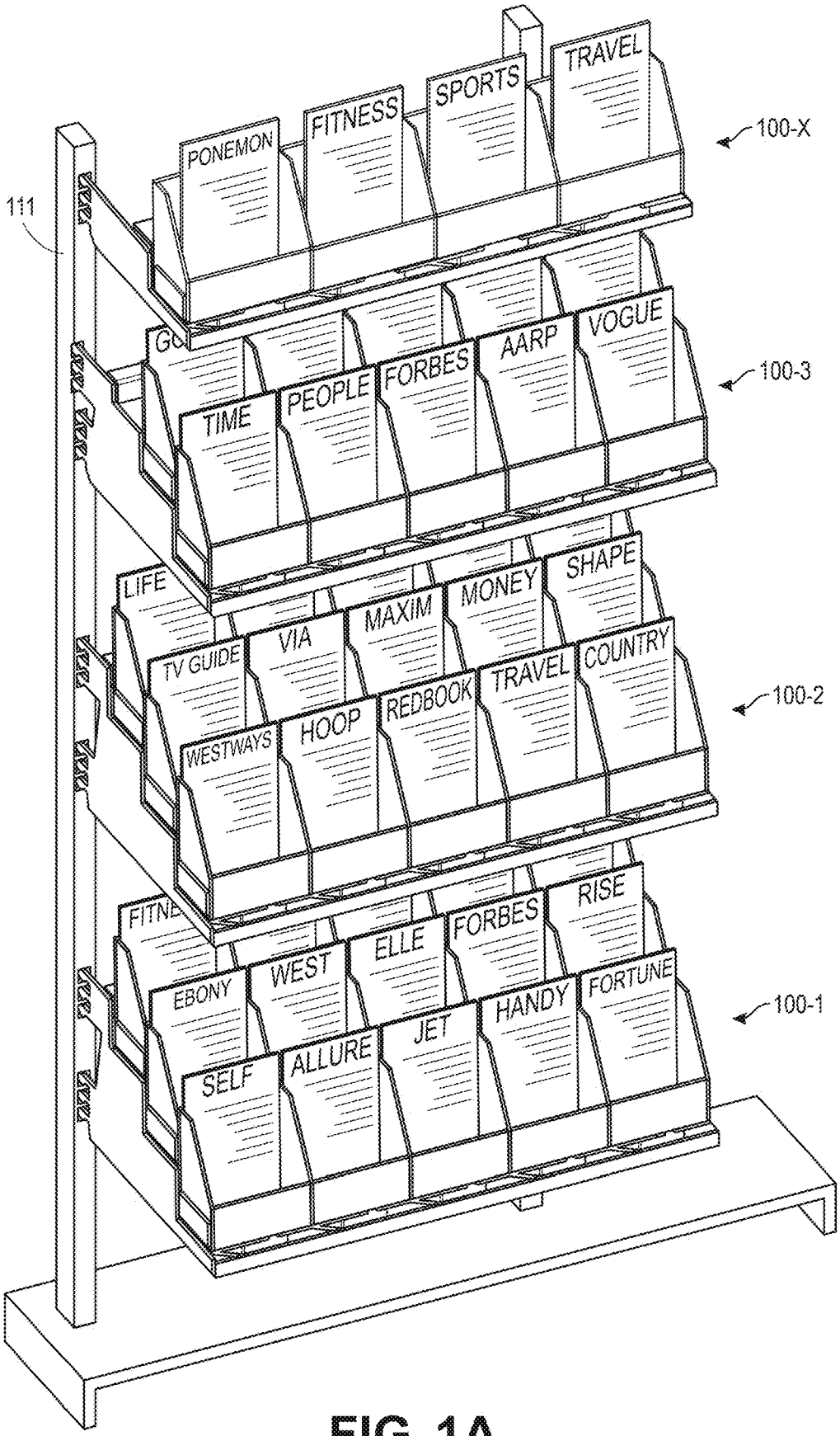
FIGS. 1A and 1B are examples of a plurality of high-density item display apparatuses with individually assignable load cells and removable bins mounted to a gondola rack, in accordance with implementations of the present disclosure.
Figure 1B:
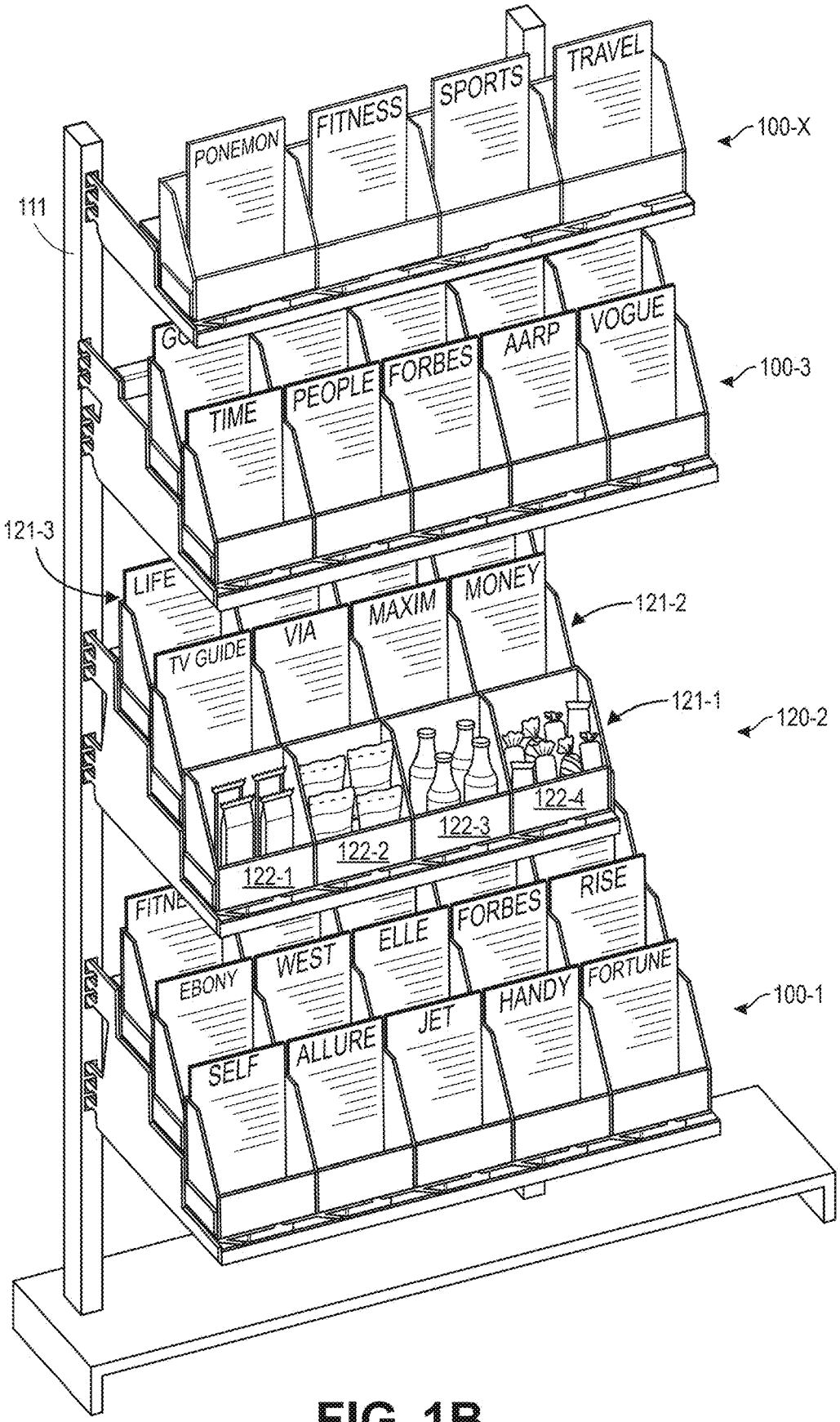

FIGS. 1A and 1B are examples of a plurality of high-density item display apparatuses 100-1, 100-2, 100-3, through 100-X with individually assignable load cells and removable bins mounted to a gondola rack 111, in accordance with implementations of the present disclosure.

In the example illustrated in FIG. 1A, there are four high-density item display apparatuses 100-1, 100-2, 100-3, through 100-X mounted to the gondola rack 111. As will be appreciated, any number of high-density item display apparatuses may be mounted to any number of gondolas, or other mounting structures, such as walls, poles, other shelving units, or to other high-density item display apparatuses. Accordingly, each high-density item display apparatus 100-1 through 100-X may be completely independent of one another.

In the illustrated example, each apparatus 100 may be manufactured to fit any size gondola rack, such as four feet wide and ninety inches tall gondola rack, also known as a Lozier gondola, 1250 millimeter wide gondola rack, also known as Eden gondola, or any other dimension of gondola rack. In other examples, the apparatus 100 may be manufactured to fit or mount to any other surface or mounting structure and the mounting configuration to a gondola rack as discussed herein is for explanation purposes only.

In addition to the width of the apparatus and to what it may be configured to mount, the apparatus, in accordance with disclosed implementations, may include any number of rows for bins and any number of bins per row. In some implementations, the rows may be arranged in a cascading stair step configuration. In other implementations, the rows may be planar. In addition, while the examples discussed herein describe the substantially elongated surface of each row oriented horizontally, in other implementations, the substantially elongated surface of one or more rows may be oriented vertically, or at any other angle with respect to horizontal. As will be appreciated, the high-density item display apparatus may have any number of rows, with any number of load cells with bin mounting components for each row, and the configuration/orientation of the rows may vary. Likewise, the bins may be of any appropriate shape or configuration that may be mounted as part of the apparatus, as discussed herein.

In the example illustrated in FIG. 1A, the first high-density item display apparatus 100-1 includes three rows of bins, each row arranged in a cascading stair step configuration and including five bins, and each of the bins are of a configuration designed to hold standard dimension magazines in a substantially upright orientation. Likewise, the second high-density item display apparatus 100-2 also includes three rows, each row arranged in a cascading stair step configuration and including five bins, and each of the bins are of a configuration designed to hold standard dimension magazines in a substantially upright orientation. In comparison, the third high-density item display apparatus 100-3 includes two rows, each row arranged in a cascading stair step configuration and including five bins, and each of the bins are of a configuration designed to hold standard dimension magazines in a substantially upright orientation. Finally, the top high-density item display apparatus 100-X illustrated in FIG. 1A includes a single row with four bins and each bin is of a configuration designed to hold special edition magazines which are wider than standard edition magazines.

In comparison, referring to FIG. 1B, illustrated is the gondola 111 that has the same first high-density item display apparatus 100-1, the same third high-density item display apparatus 100-3, and the same top high-density item display apparatus 100-X. However, the second high-density item display apparatus 100-2 illustrated in FIG. 1A is replaced with a different configuration high-density item display apparatus 120-2. In the example high-density item display apparatus 120-2, which includes three rows 121-1, 121-2, 121-3, the first row 121-1 includes four bins 122-1, 122-2, 122-3, 122-4 that are configured to hold items other than magazines. In the illustrated example, the first bin 122-1 includes candy bars, the second bin 122-2 includes chips, the third bin 122-3 includes soda bottles, and the fourth bin 122-4 includes candy.

As illustrated and discussed herein, each bin that may be utilized with the disclosed implementations includes a base having a top surface and a bottom surface and at least one side coupled to the base and positioned at an angle with respect to the top surface of the base such that one or more items of an item type may be placed in the bin and presented for display. Each bin also includes a bin alignment component, discussed further below, coupled to the bottom surface of the base and operable to mount with a bin mounting component of the high-density item display apparatus and secure the bin to the high-density item display apparatus. In other implementations, the bin alignment component of a bin may be coupled to other surfaces of the bin. For example, if the row of the high-density item display apparatus is oriented vertically, the bin alignment component may be on a back surface of the bin so that the bin can couple with the bin mounting component of the vertically oriented load cell/row of the high-density item display apparatus. Likewise, while the examples discussed herein describe a bin having a base and at least one side to hold or support one or more items of an item type, in other implementations, the bin may have a different configuration or different mechanism to couple the bin with a bin mounting component of a high-density item display apparatus and/or to hold or support inventory items. For example, in some implementations, a bin may include or utilize a hook as the bin alignment component to mount the bin to a bin mounting component of a high density item display apparatus. In still other implementations, one or more bins may be permanently connected to the high-density item display apparatus. In general, the disclosed implementations may be utilized with any configuration of bin and any form of coupling, whether permanent or removable, between a bin and a load cell of a high-density item display apparatus provided that there is a one-to-one correlation between a bin and a load cell when the bin is coupled to the high-density item display apparatus.

As illustrated, each high-density item display apparatus may be configured to have any number of rows and any number of bins per row, with different quantities of bins in different rows of the same high-density item display apparatus. Likewise, as discussed further below, the disclosed implementations may be used to accurately track, for each bin, item picks and item places of any item type associated with the bin that has a measurable per item weight (e.g., magazines, greeting cards, sodas, chips, candy, keychains, cards, etc.). Accordingly, while magazines are primarily discussed herein as examples, it will be appreciated that the disclosed implementations may be utilized to detect item picks, item places, and inventory for any individually countable item type that has a relatively consistent item weight between each item of the item type.

Figure 2:
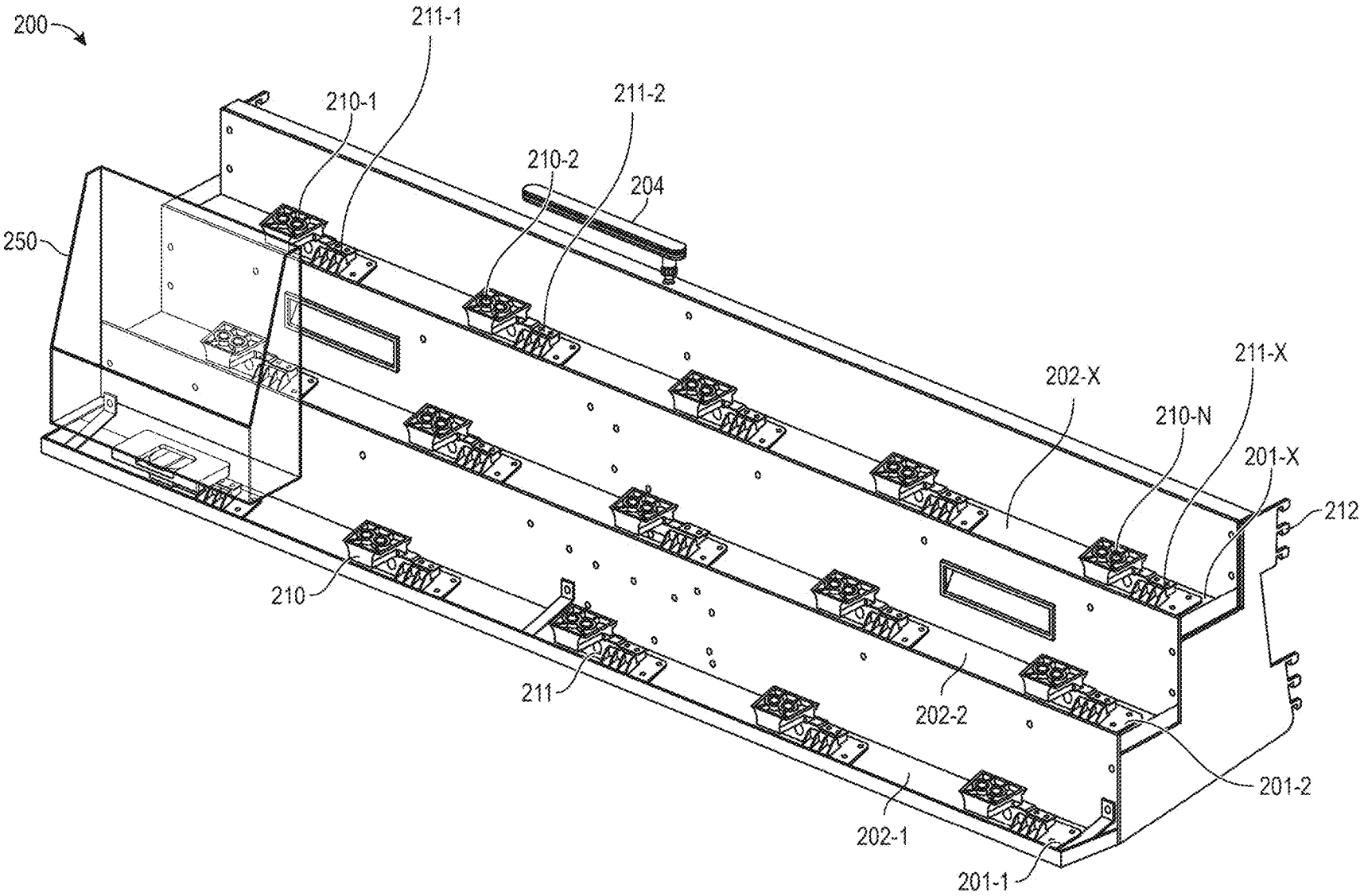
FIG. 2 is an illustration of a high-density item display apparatus with individually assignable load cells, in accordance with implementations of the present disclosure.

FIG. 2 is an illustration of a high-density item display apparatus 200 with individually assignable load cells 211, in accordance with implementations of the present disclosure.

As illustrated, each row 201-1, 201-2, through 201-X may include one or more elongated surfaces 202-1, 202-2, through 202-X to which any number of load cells 211-1, 211-2, through 211-X may be attached (fixedly positioned) at any equal or unequal position along the elongated surfaces. In some implementations, the elongated surfaces may be substantially horizontal with respect to the apparatus. Likewise, in examples that have multiple elongated surfaces, such as the example illustrated in FIG. 2, the surfaces may be substantially parallel and arranged in a cascading step fashion in which each elongated surface is positioned as a step that is above the adjacent substantially horizontal elongated display surface. Still further, while the illustrated examples indicate the elongated surfaces as substantially horizontal, in other implementations, the elongated surfaces may be positioned at angles.

The load cells 211-1 through 211-X may be, for example, single point full-bridge strain gauge load cells. A full-bridge configuration may be utilized to reduce errors from potential temperature drift characteristics as compared to a half-bridge load cell. In other implementations half-bridge load cells and/or any other type of load cell may be utilized.

Typical magazines, and/or other items that may be included on a high-density item display apparatus, often weigh between 110 grams ("g") and 725 g. Considering that up to three items may be picked simultaneously, the maximum measurement range is between 0.1 kilogram ("kg") to 2.2 kg. In some implementations, the load beams of the load cells 211 may be machined from aluminum, such as 2023-T351 Aluminum. Utilizing aluminum for the load cell beams provides low hysteresis characteristics. Because customers will be directly interacting with items (e.g., magazines) in bins of the high-density item display apparatus, the bins provide a substantial lever arm on the load cell 211. In some implementations, the utilized load cell 211 may have an overload rating of 36 kg with a counting reliability as low as 15 g. Because each load cell 211 supports only one bin and the lightest item that is typically included in a bin of a high-density item display apparatus weighs about 100 g, accuracy with such a configuration is maintained almost regardless of the item type to be included in a bin.

As illustrated and as discussed further below, each load cell 211 may include a bin mounting component 210-1, 210-2, through 210-N. Each bin mounting component 210-1 through 210-N may be configured to enable detachable coupling with a bin 250 so that a bin 250 can be detachably coupled to the high-density item display apparatus 200 and singly associated with a load cell 211. In some implementations, the bin mounting components 210 may include snap connectors so that bins 250 may be attached, detached, replaced, etc., thereby increasing the configuration options for each load cell 211 of the apparatus 200. For example, any number of different shapes of bins 250 (e.g., bins for magazines, bins for candy, bins for chips, bins for drinks, etc.), may be detachably coupled to a load cell 211 of the apparatus 200.

Wiring for communication and power to and from each load cell 211 may be routed behind the structure and out of view of customers. For example, power and communication cables may be routed between each load cell 211 to a PCBA that is affixed to and included as part of the apparatus 200. The PCBA may enable power to each load cell 211 and/or receive data communications from each load cell 211. In other implementations, power may be provided directly to each load cell 211, rather than through the PCBA.

Also included in the apparatus 200 is a communication component 204, such as an antenna, that is coupled to the PCBA to enable transmission of data, such as load call data (also referred to herein as weight data), from the apparatus 200 and/or receipt of data, such as an indication of item types and/or item weights associated with the different load cells 211.

Finally, in the illustrated example, the apparatus 200 includes one or more mounting brackets 212 to enable mounting of the apparatus 200 to a structure, such as a gondola, pole, wall, and/or other surface.

Figure 3:
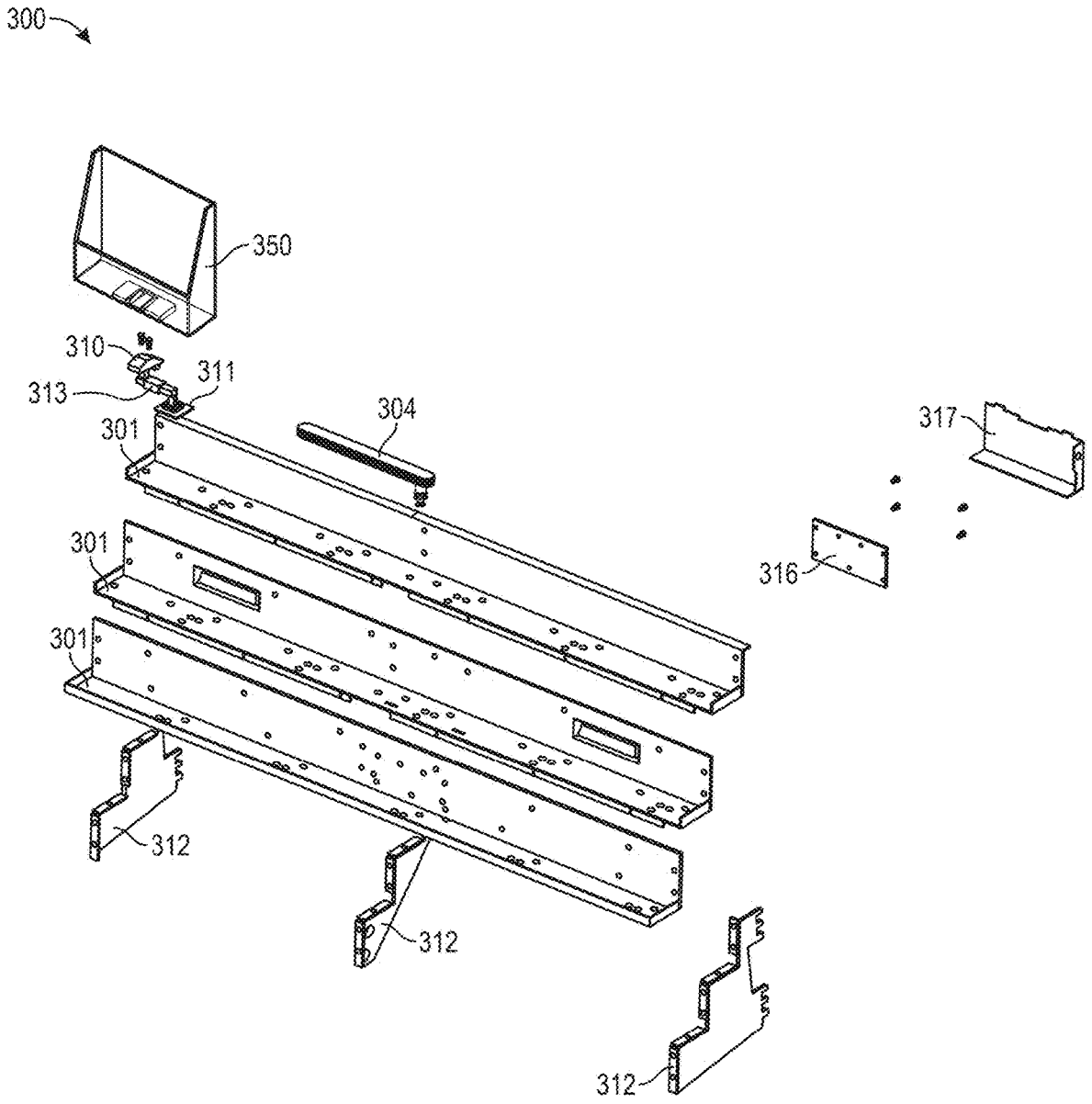
FIG. 3 is a component view of the high-density item display apparatus illustrated in FIG. 2, in accordance with implementations of the present disclosure.

FIG. 3 is a component view of the high-density item display apparatus 300 illustrated in FIG. 2, in accordance with implementations of the present disclosure.

As illustrated and discussed above with respect to FIG. 2, the apparatus 300 may include a plurality of load cells 311, corresponding load cell beams 313, and bin mounting components 310. Each load cell 311 may be coupled to an elongated surface 301 and, in some implementations, multiple steps or sections of elongated surfaces 301 may be arranged in a cascading or step structure to form the apparatus 300. Likewise, load cell beams 313 may couple the bin mounting components 310 to the load cell 311 such that when a bin 350 is mounted to the bin mounting component 310 the bin 350 is supported by the load cell 311 and a one-to-one connection is maintained between the bin 350 and the load cell 311.

Each of the elongated surfaces 301 may be coupled together via the mounting brackets 312. The mounting brackets 312 may be positioned at either end of the elongated surfaces 301 and/or positioned at locations between the ends of the elongated surfaces 301. As discussed above, the mounting brackets 312 may be positioned to allow mounting of the apparatus 300 to another structure, such as a gondola, pole, wall, etc. In some implementations, the mounting brackets 312 may be adjustable to enable mounting of the high-density item display apparatus 300 to different surfaces. The elongated surfaces 301 may be composed of sheet metal parts, steel, plastic, or other substantially rigid material. Likewise, the elongated structures may be interchangeable between different configurations of the apparatus 300, whether it be a single tier apparatus, two-tier apparatus, three-tier apparatus, etc.

The elongated surfaces 301 may be welded, riveted, or otherwise coupled together to form the apparatus 300 in a stair-step-cascade structure that accurately positions the load cells 311 and coupled bins 350 and provides mounting points to a gondola or other structure.

Communication and/or power lines from each of the load cells 311 may be routed behind the elongated surfaces 301, out of view from customers, to a PCBA 316 that may be coupled to the apparatus 300, such as to a rear surface of an elongated surface by a PCBA cover 317. Likewise, a communication component 304, such as an antenna or other transmitter/receiver may be communicatively coupled to the PCBA 316 to transmit and/or receive data to/from the apparatus 300.

Figure 4:
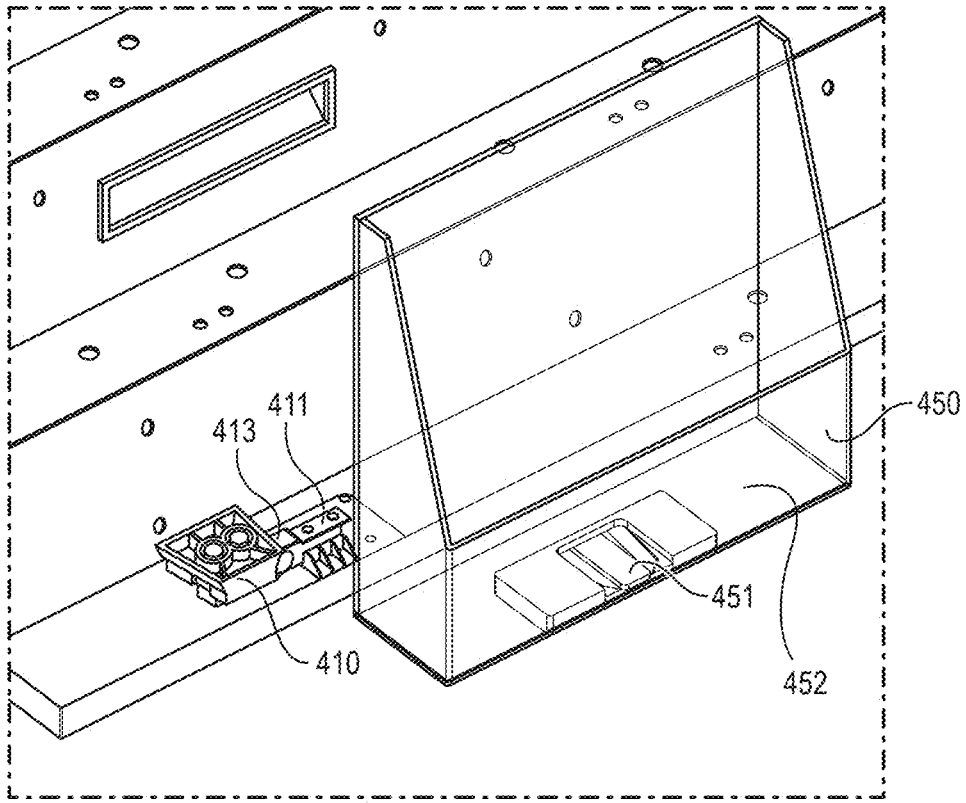
FIG. 4 is an illustration of a load cell, detachable bin, and bin mounting component of the high-density item display apparatus, in accordance with implementations of the present disclosure.

FIG. 4 is an illustration of a load cell 411, detachable bin 450, bin mounting component 410, and load cell beams 413 of the high-density item display apparatus, and a bin alignment component 451 positioned along a base 452 of the bin 450, in accordance with implementations of the present disclosure.

The bin mounting component 410 may be configured to receive the bin alignment component 451 such that the bin alignment component 451 snaps into place and secures the bin 450 in the proper alignment with respect to the load cell 411 so that the pick and/or place of an item from or to the bin can be accurately detected by the load cell 411. Likewise, an operator may remove the bin by pushing up on the bin alignment component 451 of the bin 450 so that the bin can be removed and replaced.

Figure 5:
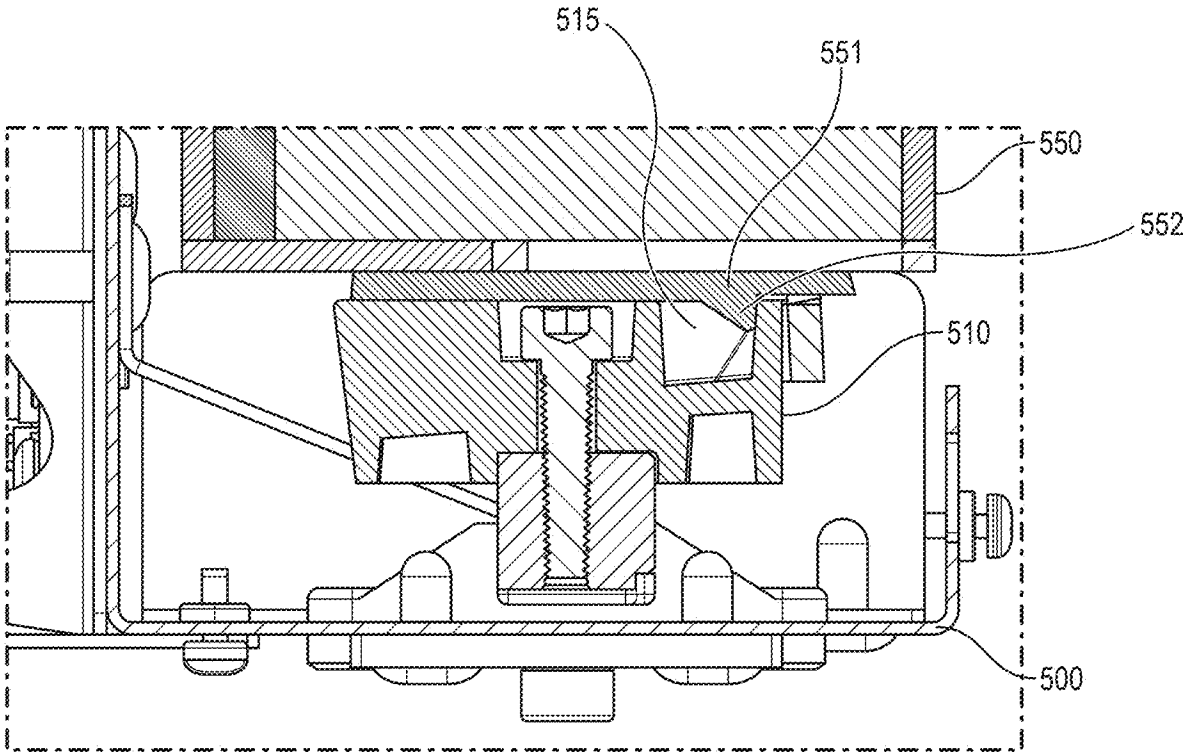
FIG. 5 is a cross section view of the bin mounting component of the high-density item display apparatus with an attached bin, in accordance with implementations of the present disclosure.

For example, FIG. 5 illustrates a cross section view of the bin mounting component 510 of the high-density item display apparatus 500 with an attached bin 550, in accordance with implementations of the present disclosure. As illustrated, the snap 552 of the bin alignment component 551 of the bin 550 secures the bin into place when the snap 552 enters the pocket 515 of the bin mounting component 510. Likewise, when the operator pushes up on the snap 552, the snap 552 is removed from the pocket 515 so that the bin 550 can be removed from the bin mounting component 510.

Figure 6:
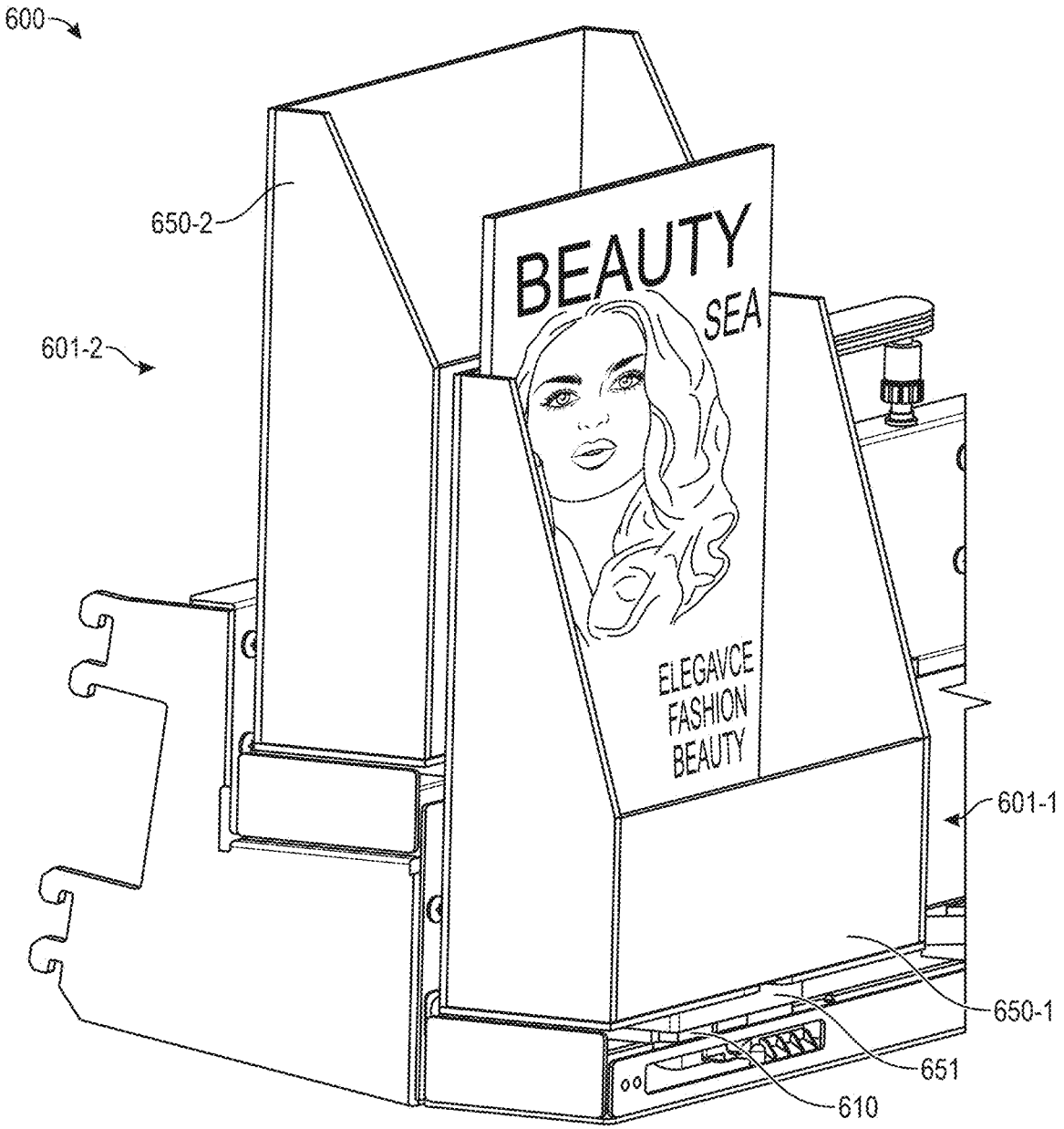
FIG. 6 is an illustration of a portion of the high-density item display apparatus with two rows and two mounted detachable bins, in accordance with implementations of the present disclosure.

FIG. 6 is an illustration of a portion of the high-density item display apparatus 600 with two rows 601-1, 601-2 and two mounted detachable bins 650-1, 650-2, in accordance with implementations of the present disclosure.

As illustrated and as discussed herein, the elongated surface may be arranged in a cascading or step structure to form the apparatus 600. Likewise, each elongated surface includes load cells and bin mounting components 610 that are operable to receive and secure bin alignment components 651 of a bin 650-1/650-2. By arranging the elongated surfaces in a cascading or step structure, the mounted bins 650-1/650-2 are arranged in a stepped high-density arrangement so that items, such as magazines, positioned in the bins 650 are viewable in a stair-step arrangement.

Figure 7:
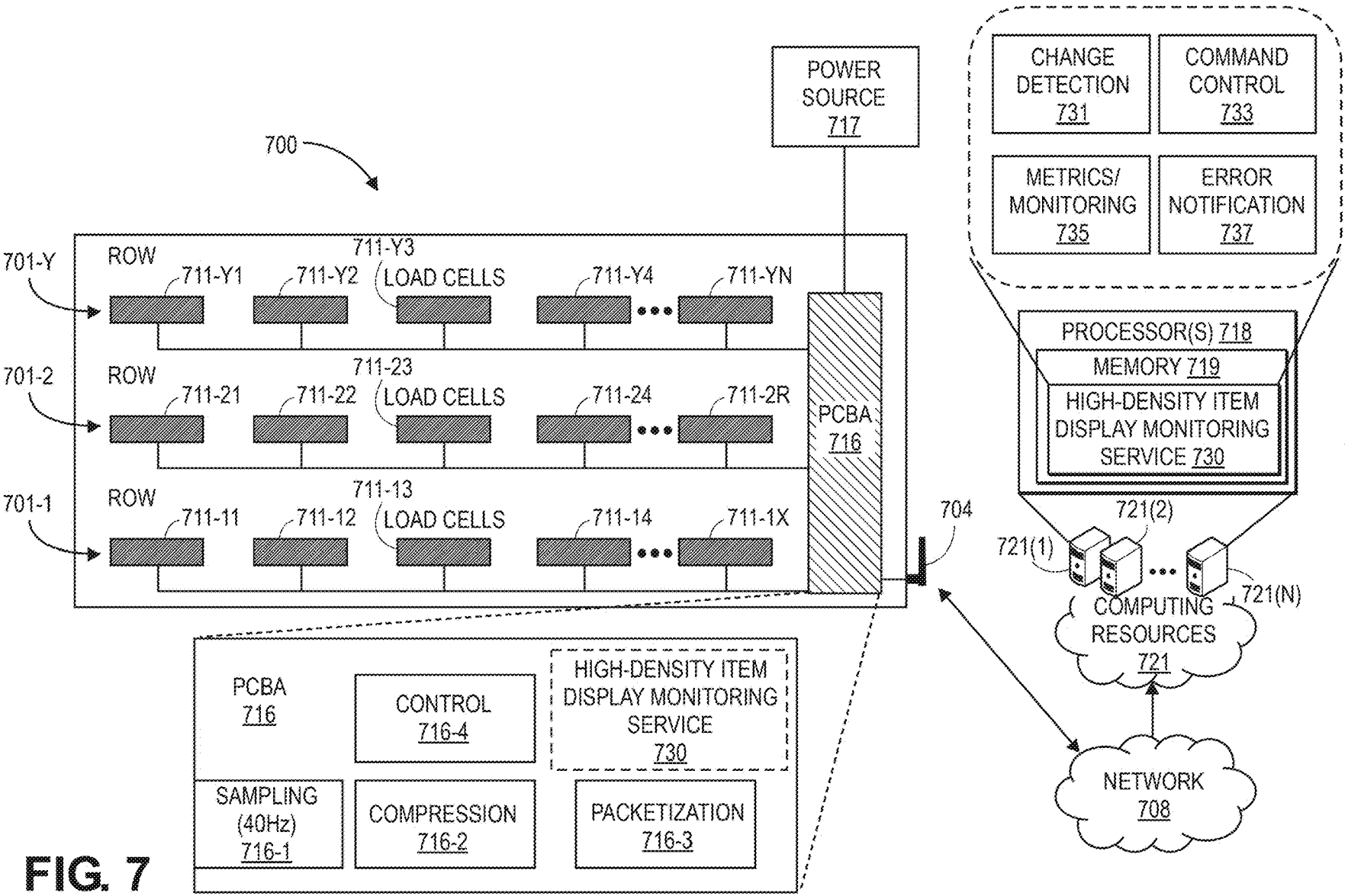
FIG. 7 is an illustration of a load cell arrangement of the high-density item display apparatus and a communication between the high-density item display apparatus and one or more computing resources, in accordance with implementations of the present disclosure.

FIG. 7 is an illustration of a load cell arrangement of the high-density item display apparatus 700 and a communication between the high-density item display apparatus 700 and one or more computing resources 721, in accordance with implementations of the present disclosure.

As illustrated, each row 701-1, 701-2, through 701-Y of the high-density item display apparatus may include a plurality of load cells and each of the plurality of load cells 711 of a row may be coupled directly to a PCBA 716 of the apparatus 700. For example, a first row 701-1 may include load cells 711-11, 711-12, 711-13, 711-14, through 711-1X. The second row 701-2 may include load cells 711-21, 711-22, 711-23, 711-24, through 711-2R. The Yth row 701-Y may include load cells 711-Y1, 711-Y2, 711-Y3, 711-Y4, through 711-YN. As will be appreciated, the apparatus may include any number of rows 701-1 through 701-Y and each row may include any number of load cells 711. Likewise, each row 701-1 through 701-Y may include the same or different number of load cells 711. Each load cell 711 of each row of the apparatus 700 may be individually addressable and be identifiable by an address or other identifier. For example, as discussed herein, each load cell 711 may transmit weight data and/or weight change data to the PCBA 716 of the apparatus 700. The PCBA 716 may maintain a planogram or other mapping indicating the position or assignment of all connected load cells 711 of the high-density item display apparatus 700. Upon receipt of weight data and/or weight change data from a load cell 711, the PCBA 716 may determine the unique load cells from which the data was received and assign a load cell identifier to the weight data and/or weight change data identifier to the load cell or position of the load cell that transmitted the data. For example, in some implementations, each load cell 711 may periodically transmit weight data indicating a currently measured weight by the load cell 711 and the PCBA 716, upon receiving the weight data from each load cell, may assign a load cell identifier to the weight data that uniquely identifies the load cell 711 from which the weight data was received. In other implementations, each load cell 711 may only transmit a weight change data when a measured weight at the load cell 711 changes by more than a defined amount (e.g., 30 g). For ease of explanation, weight data transmitted by a load cell 311 to the PCBA 716, whether it be weight change data, weight data, or other indicator of weight determined by the load cell 711 is collectively referred to herein as "weight data" and weight data, as used herein, refers to any type of weight related data that may be transmitted by a load cell 711.

The PCBA 716 may be configured to receive the weight data transmitted by each load cell 711 of the high-density item display apparatus 700 and determine whether to transmit the weight data to the computing resources 721. In some implementations, all received weight data may be transmitted by the PCBA 716 to the computing resources 721. In other implementations, the PCBA 716 may initially process some or all of the weight data and determine what weight data to transmit to the computing resources 721. For example, as weight data is received from a load cell 711 of the apparatus, the PCBA 716 may compare the weight data with a previously received weight data for that load cell 711. If the weight data has not changed by at least a defined amount, the weight data may not be transmitted. In comparison, if the weight data of the load cell 711 has changed by at least a defined amount, the PCBA 716 may transmit the weight data and load cell identifier that provided the weight data to the computing resources 721. In still other examples, the PCBA 716 may process weight data received from a load cell 711 and, if the weight data has changed, determine a quantity of an item picked and/or placed from/to the load cell 711 and transmit the quantity change to the computing resources 721.

As illustrated in the expanded view, the PCBA 716 may include, among other components, a sampling component 716-1, a compression component 716-2, a packetization component 716-3, a control component 716-4, and/or a high-density item display monitoring service 730. The sampling component 716-1 may control a sampling rate of each of the load cells 711 of the apparatus 700 that are coupled to the PCBA 716. For example, the sampling component 716-1 may regulate a sampling of the load cells at a 40 Hertz (Hz) sampling rate. In other implementations, the sampling rate may be higher or lower. In some implementations, the sampling component 716-1 may include or utilize one or multiplexers to enable sampling of the multiple load cells at a defined sampling rate. For example, if there are sixteen load cells, the sampling component may utilize two 8-channel multiplexers to enable sampling of each of the sixteen different load cells. In one example, the sampling component 716-1 may utilize five signals: two complimentary multiplexer select signals and three channel select signals to select between the different multiplexers and the different channels of each multiplexer.

The compression component 716-2 may be configured to compress or otherwise combine the weight data received from each of the load cells 711 of the apparatus 700 to enable efficient data transfer of the weight data from the PCBA 716 to the computing resources 721. In some implementations, the compression component 716-2 may include data with each data stream of compressed data indicating the load cell identifiers corresponding to the data included in the data stream. The packetization component 716-3 may packetize the compressed data to enable transmission of the data from the PCBA 716 to the computing resources 721, such as transmission via a network 708, such as the Internet. In some implementations, some or all of the high-density item display monitoring service 730 may be included on the PCBA 716. As discussed below, the high-density item display monitoring service 730 may perform a variety of functions, including determination of weight changes at a bin, item picks, item places, etc. As illustrated, some or all of the high-density item display monitoring service 730 may be included on the PCBA 716, some or all of the high-density item display monitoring service 730 may be included on the computing resources 721, or any combination thereof. For example, a first portion of the high-density item display monitoring service 730 that determines whether a weight change has occurred at a bin may be included on the PCBA 716 and a second portion of the high-density item display monitoring service may be included on the computing resources 721 that determines, based on weight data received from the PCBA 716, if an item was picked, placed, or if an error has occurred.

Finally, the control component 716-4 may control the signaling and transmission of data to/from the PCBA 716, providing timing for the sampling component, etc. Likewise, the PCBA 716 may receive power from a power source 717 that provides power to the PCBA 716, as well as power to the load cells 711 of the apparatus 700. The power source 717 may be any source of power and may be internal to the apparatus 700 or external from the apparatus 700. For example, the power source 717 or power supply may receive power via Power over Ethernet ("PoE"), alternating current ("AC") power, such as from an electrical outlet or directly connected electrical circuit, direct current ("DC") power, battery power, Universal Serial Bus ("USB") power source, solar power, etc.

The communication component 704, such as an antenna or other wired or wireless transmission component, may transmit data to and/or from the apparatus 700 via a network 708 to the computing resources 721, which may be remote from the apparatus 700.

In some implementations, the PCBA 716 and/or the high-density item display apparatus 700 may also include a presence detection sensor to detect presence of an object (e.g., human) within a defined distance of the high-density item display apparatus. For example, the apparatus 700 may include a presence detection sensor, such as an infrared sensor or Passive InfraRed ("PIR") sensor that detects radiation emanating from objects when present in a field of view of the sensor. In such a configuration, the presence detection sensor may be communicatively coupled to the PCBA 716 and provide a signal to the PCBA 716 upon detection of a presence of an object. The PCBA 716 may utilize information received from the sensor to aid in detection of item picks and/or items placed from/to bins of the high-density item display apparatus 700. Likewise, the PCBA 716 may utilize information from a presence detection sensor to transition some or all components of the apparatus 700 between a high power state to a low power state (when an object is not detected as present) or between a low power state to a high power state (when an object is detected as present), thereby reducing the power consumed by the apparatus 700.

In still other examples, the PCBA 716 may be configured to receive information from other sources, such as imaging elements within a vicinity of the high-density item display apparatus 700 and/or an inventory management system (discussed below) in communication with the high-density item display monitoring service. For example, the inventory management system, as discussed further below, may monitor the position of users present in a materials handling facility and provide information to the PCBA 716 indicating when a user is near or approaching the high-density item display apparatus 700. In such a configuration, the PCBA 716 may utilize the information received from the inventory management system to transition one or more components of the apparatus 700 between high power and low power states and/or the high-density item display monitoring service 730 may utilize information received from the inventory management system as additional information in determining whether a pick or a place of an item has occurred.

As illustrated, the computing resource(s) 721 may be implemented as one or more servers 721(1), 721(2), . . . , 721(N) and may, in some instances, form a portion of a network-accessible computing platform implemented as a computing infrastructure of processors, storage, software, data access, and so forth that is maintained and accessible by components/devices of the system via a network 708, such as an intranet (e.g., local area network), the Internet, etc. The computing resources 721 may process weight data and determine whether a change has occurred at a load cell 711 of one or more high-density item display apparatuses 700. Such change detection may be provided to one or more other components of an overall system. For example, a management system (discussed below) may monitor inventory for a location, provide cashierless shopping that detects item picks by customers, automatically associates picked items with the customer, and ultimately charges the customer for the item, etc.

The server system(s) 721 does not require end-user knowledge of the physical location and configuration of the system that delivers the services. Common expressions associated for these remote computing resource(s) 721 include "on-demand computing," "software as a service (SaaS)," "platform computing," "network-accessible platform," "cloud services," "data centers," and so forth. Each of the servers 721(1)-(N) include a processor 718 and memory 719, which may store or otherwise have access to a high-density item display monitoring service 730, as described herein.

The network 708, and each of the other networks discussed herein, may utilize wired technologies (e.g., wires, USB, fiber optic cable, etc.), wireless technologies (e.g., radio frequency, infrared, NFC, cellular, satellite, Bluetooth®, etc.), or other connection technologies. The network 708 is representative of any type of communication network, including data and/or voice network, and may be implemented using wired infrastructure (e.g., cable, CAT6, fiberoptic cable, etc.), a wireless infrastructure (e.g., RF, cellular, microwave, satellite, Bluetooth®, etc.), and/or other connection technologies.

The computing resources may include a high-density item display monitoring service 730 that receives weight data from one or more high-density item display apparatuses and process that data to determine actions (e.g., item pick, item place) occurring at one or more load cells 711 of each of the high-density item display apparatuses 700. For example, the monitoring service 730 may include a change detection component 731, a command/control component 733, a metrics/monitoring component 735, an error notification component 737, etc. As noted above, in some implementations, some or all of the high-density item display monitoring service 730 may be included on the PCBA 716 of the high-density item display apparatus 700.

The change detection component 731 may process received weight data for a load cell 711 from a high-density item display apparatus 700 and, based on the known item type and item weight of the item type associated with the load cell 711 determine if a change has occurred. If a change has occurred, the change detection component 731 may determine if the change is an item pick, an item place, or an error. For an item pick, which is the removal of one or more items from the bin attached to the load cell 711, the change detection component may determine, based on the weight data, the quantity of picked items of the item type. For an item place, which is the placement of one or more items into the bin attached to the load cell 711, the change detection component 731 may determine, based on the weight data, the quantity of items placed into the bin attached to the load cell. An error may be determined if the change in the weight determined at the load cell 711, whether a pick or a place, does not equal, within a defined margin of error, a multiple of the item weight of the item type associated with the load cell 711 to which the bin is mounted. Such an error may occur if, for example, a customer picks a first item from a first bin of the apparatus 700 and then places that item into another bin of the apparatus 700. In such an example, the change detection element 731 may detect the item pick from the first bin and then detect an item place into a second bin. However, because the second bin did not previously experience an item pick and/or because the item weight of the item placed into the second bin is not a multiple of the item weight of the item type associated with the second bin, an error may be detected.

If the change detection component 731 determines that an item place to a bin is not proceeded, within a defined period of time, by an item pick from that bin (or an item pick from a bin with the same item type) and/or determines that a weight change corresponding to an item place to a bin does not correspond to an item weight of an item type associated with that bin, the change detection component 731 may provide a notification to the error notification component 737.

The error notification component 737, upon receiving an indication of an error from the change detection component 731, may determine one or more actions to be performed in response to the error. For example, the error notification component 737 may send an error notification to an operator at the physical location of the apparatus 700 informing the operator that an item has been misplaced into a bin of the apparatus 700. In some implementations, the notification may indicate the bin into which the item was misplaced, an expectation of what item may have been placed to that bin (e.g., based on a prior item pick from the same or different high-density item display apparatus at the location), where the misplaced item should be properly placed, etc.

The command control component 733 may send updates to different PCBAs of different high-density item display apparatuses and/or provide different modes of operations for each high-density item display apparatus 700. For example, an operator, through interaction with the computing resource 721 (directly or through a separate interface) may transition the apparatus 700 from an operation mode to an inventory mode. While in an inventory mode the operator may, for example, identify an item type that is to be associated with a particular bin/load cell of the apparatus and place an item of the item type into the bin. Upon placement of the item of the item type into the bin, during inventory mode, the load cell will transmit the weight data indicating the weight of the item type. The PCBA 716 will receive and provide the weight data transmitted by the load cell 711 to the computing resource 721, and the command control component 733 may associate the item weight and the identified item type with the load cell 711. This operation may be done for some or all of the load cells and bins of the apparatus 700 while the apparatus is in inventory mode. The operator may then place the apparatus 700 into operation mode where the apparatus 700 is monitoring for and detecting item picks and/or item places from/to each bin of the apparatus 700. In other implementations, individual bins of a high-density item display apparatus 700 may be transitioned between an inventory mode and an operation mode while other bins/load cells remain in the operation mode.

Finally, in some implementations, the high-density item display monitoring service 730 may also include a metrics/monitoring component 735. The metrics/monitoring component 735 may monitor the velocity of items at different bins of different high-density item display apparatus 700, determine when inventory is low at a bin, determine when an item of an item type is to be replaced/updated, and/or monitor other key performance indicators ("KPI") for item types at the apparatus 700 and/or for other aspects of the apparatus 700. Such metrics and/or KPIs may be periodically reported to one or more operators and/or otherwise utilized.

Figure 8:
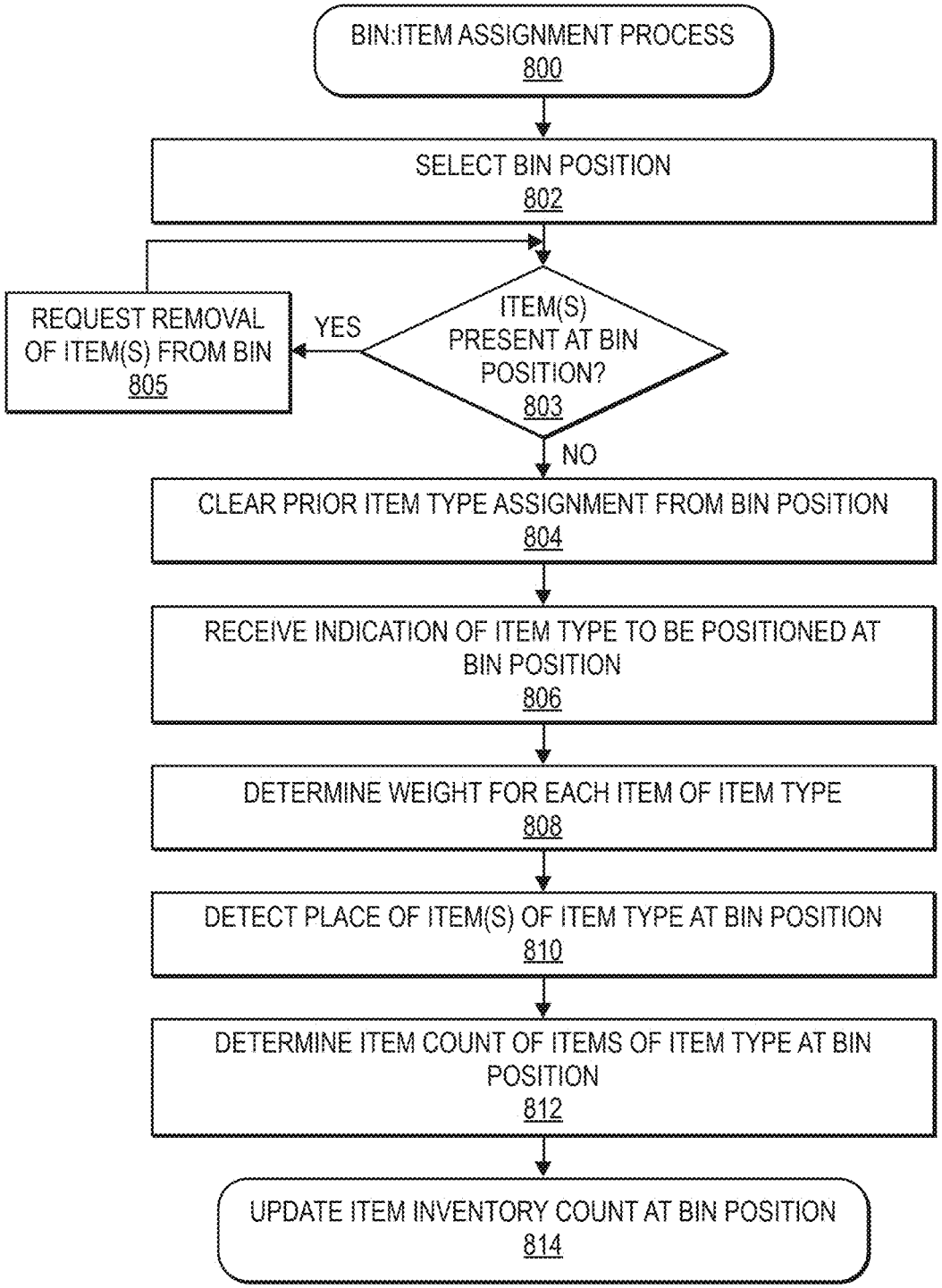
FIG. 8 is an example bin: item assignment process, in accordance with implementations of the present disclosure.

FIG. 8 is an example bin: item assignment process 800, in accordance with implementations of the present disclosure. The example process 800 may be performed on a per bin/load cell, for all bins of a row of a high-density item display apparatus, for all bins/load cells of the high-density item display apparatus, etc.

The example process 800 begins by selecting a bin position for which an item type is to be associated, as in 802. In some implementations, the operator may specify which bin/load cell is to be processed by the example process 800. In other implementations, the bin/load cell may be specified by the example process 800. The bin position may be defined in a planogram for the high-density item display apparatus, defined based on a unique identifier corresponding to the load cell to which the bin is coupled, etc.

Upon selection of a bin position, a determination may be made as to whether any items are currently present in the bin corresponding to the bin position, as in 803. For example, weight data received from the load cell corresponding to the bin position may be processed to determine if any items are present at the bin position. Alternatively, or in addition thereto, an inventory count of items of an item type currently associated with the bin position may be queried to determine if there are any items of an item type for which an inventory count is maintained for the bin position.

If it is determined that one or more items are currently positioned in the bin corresponding to the bin position, the example process may send a notification (e.g., to an operator) requesting that all current items at the bin position be removed from the bin at that bin position, as in 805, and the example process may continue until it is determined at decision block 803 that there are no items at the bin position. Once it is determined at decision block 803 that there are not any items present in the bin corresponding to the bin position, any prior item type assignment associated with the bin/load cell position is cleared from memory, as in 804. The memory may include, for example, memory on the PCBA of the high-density item display apparatus, memory of the computing resource(s) in communication with the high-density item display apparatus, and/or any other memory that may maintain the item types associated with a bin position.

The example process may also receive an indication of the item type that is to be positioned at the bin position, as in 806. The item type may be received by the example process 800 through any of a variety of channels. For example, an operator may scan an identifier (e.g., Bar Code, Quick Response ("QR") code, Radio-Frequency Identification ("RFID") tag, etc.) on an item of the item type to determine the item type. In other examples, the operator may input, for example through selection on an interface or keyboard, the item type of the item to be positioned at the bin position, etc.

For the selected item type, a weight is determined for an item of the item type, as in 808. In some implementations, the weight of an item of the item type may already be known and included with the item type information. In other implementations, the example process may request that the operator place one item of the item type at the bin position and then determine the item weight of an item of the item type based on weight data transmitted from the load cell corresponding to the bin position. In still other examples, the operator or another source may provide the item weight.

Once the item type and item weight for items of the item type are associated with the bin position, the operator may be instructed to place items of the item type into the bin at the bin position, as in 810. Upon detection of items placed into the bin at the bin position, the weight data from the load cell corresponding to the bin position is received and may be processed to determine a quantity or count of items of the item type that were placed at the bin position, as in 812. For example, if each item of the item type weigh 100 g and the weight data received from the load cell indicates a weight increase of 400 g, it may be determined that a quantity of four items of the item type have been placed into the bin corresponding to the bin position.

Finally, the item inventory count for the bin position and the item type are updated to indicate the determined quantity of items placed at the bin position, as in 814.

Figure 9:
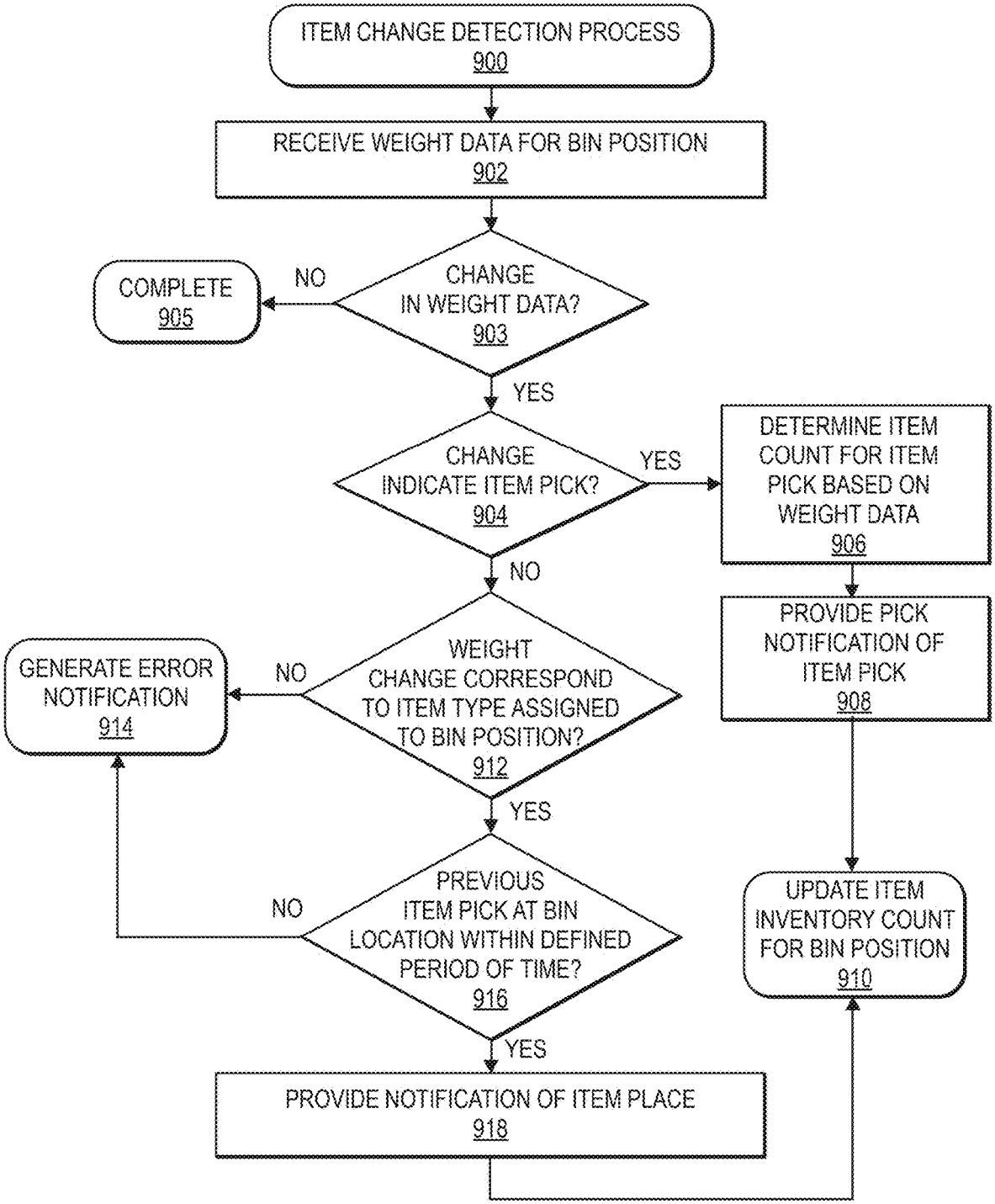
FIG. 9 is an example item change detection process, in accordance with implementations of the present disclosure.

FIG. 9 is an example item change detection process 900, in accordance with implementations of the present disclosure. The example process 900 may be performed by a computing system, such as a PCBA, of the high-density item display apparatus and/or by a computing system that is separate from the high-density item display apparatus. In other examples, a portion of the example process 900 may be performed by a computing system, such as the PCBA of the high-density item display apparatus while other portions of the example process 900 may be performed by a computing system that is separate from the high-density item display apparatus.

The example process 900 begins upon receipt of weight data generated by a load cell corresponding to the bin position, as in 902. As discussed above, in some implementations, weight data may be periodically transmitted from load cells to the PCBA of the high-density item display apparatus and/or from the PCBA to a computing resource. The weigh data may be processed to determine if a change in a weight measured by the load cell corresponding to the bin position has changed, as in 903. If it is determined that the weight has not changed, it may be determined that an item has not been picked or placed from/to the bin at the bin position and the example process 900 may complete, as in 905. In some implementations, it may be determined that no change is detected if the weight data indicates a change below a defined threshold (e.g., 50 g).

However, if a change in the weight data is determined, or a change that exceeds a defined threshold, a determination may be made as to whether the change indicated by the weight data is indicative of an item pick of an item from the bin corresponding to the bin position, as in 904. For example, if the weight data indicates a decrease in weight at the bin position, it may be determined that an item has been picked from the bin at the bin position. If it is determined that an item pick has occurred at the bin position, the weight data may be further processed to determine a quantity or item count of items of the item type that have been picked from the bin position, as in 906. As discussed above, the item weight of items of the item type associated with the bin position are known. Accordingly, the determined change in weight at the bin position may be compared or divided by the known item weight to determine a quantity of items picked from the bin at the bin position. In some implementations, the quantity may be determined as a closets divisible unit between the determined change in weight at the bin position and the item weight stored for items of the item type corresponding to the bin position. For example, if the item weight stored for items of the item type is 100 g and the weight changes indicates a decrease in weight of 315 g, it may be determined that three items of the item type have been picked from the bin at the corresponding bin position. A defined range or threshold around the stored item weight and the determined weight change allows for slight variations in item weight of the actual items at the bin position.

Upon determination of the quantity of items picked, a pick notification of an item pick that includes the item type and the quantity of the item picked from the bin position may be generated and sent, as in 908. For example, the item pick notification may be sent to one or more other services to indicate that the quantity of items picked from the bin position of the high-density item display apparatus. In some examples, the other service may determine a user positioned near the high-density item display apparatus that performed the item pick and associate the quantity of picked items with that user. In addition to providing an item pick notification, the item count or item inventory for the bin position may be updated to decrease the inventory count by the determined quantity of items picked from the bin at the bin position, as in 910.

Returning to decision block 904, if it is determined that the change does not indicate an item pick, a determination may be made as to whether the weight change corresponds to an item of the item type assigned to the bin position, as in 912. For example, if the weight change does not indicate an item pick, the weight change indicates an increase in weight, which is indicative of an item place to the bin corresponding to the bin position. Similar to an item pick, the change in weight indicated by the weight data, in this instance an increase in weight at the bin position, may be compared or divided by the stored item weight for items of the item type corresponding to the bin position and a determination made as to whether the change in item weight at the bin position is a multiple or divisible by the stored item weight, within some degree of tolerance. If the change in item weight is not a multiple or divisible by the stored item weight, an error notification may be generated and sent, for example to an operator, indicating that a place to the bin position of an unknown or incorrect item has occurred, as in 914.

If the change in item weight is a multiple or divisible by the stored item weight, within some degree of tolerance, it may be determined that the change in item weight likely corresponds to a place of an item(s) of the item type associated with the bin position, as in 912, and a determination may be made as to whether a previous item pick at the bin location of the same quantity of the item, or more, has occurred within a defined period of time of the current change in item weight corresponding to the item place, as in 916. The defined period of time may be any defined period of time and may be different for different high-density item display apparatuses, different for different rows of the high-density item display apparatus, different for different bins of the high-density item display apparatus, etc. In some implementations, if multiple bins contain the same item type, the previous item pick may be considered for each bin that is associated with the same item type.

If it is determined that a previous item pick of an item of the item type occurred within the defined period of time, a notification of an item place may be generated and sent that indicates, the bin, the item type, and the quantity of items of the item type placed to the bin corresponding to the bin position, as in 918. Likewise, the inventory count may be updated in increment the inventory count by an amount equal to the quantity of items determined to be placed to the bin at the bin position, as in 910.

If it is determined at decision block 912 that the weight change does not correspond to a multiple or divisible by the stored item weight for items of the item type associated with the bin position or if it is determined at decision block 916 that a previous item pick of the quantity of items did not occur within the defined period, an error notification may be generated indicating that an unknown or incorrect item has been placed to the bin corresponding to the bin position, as in 914.

Figure 10:
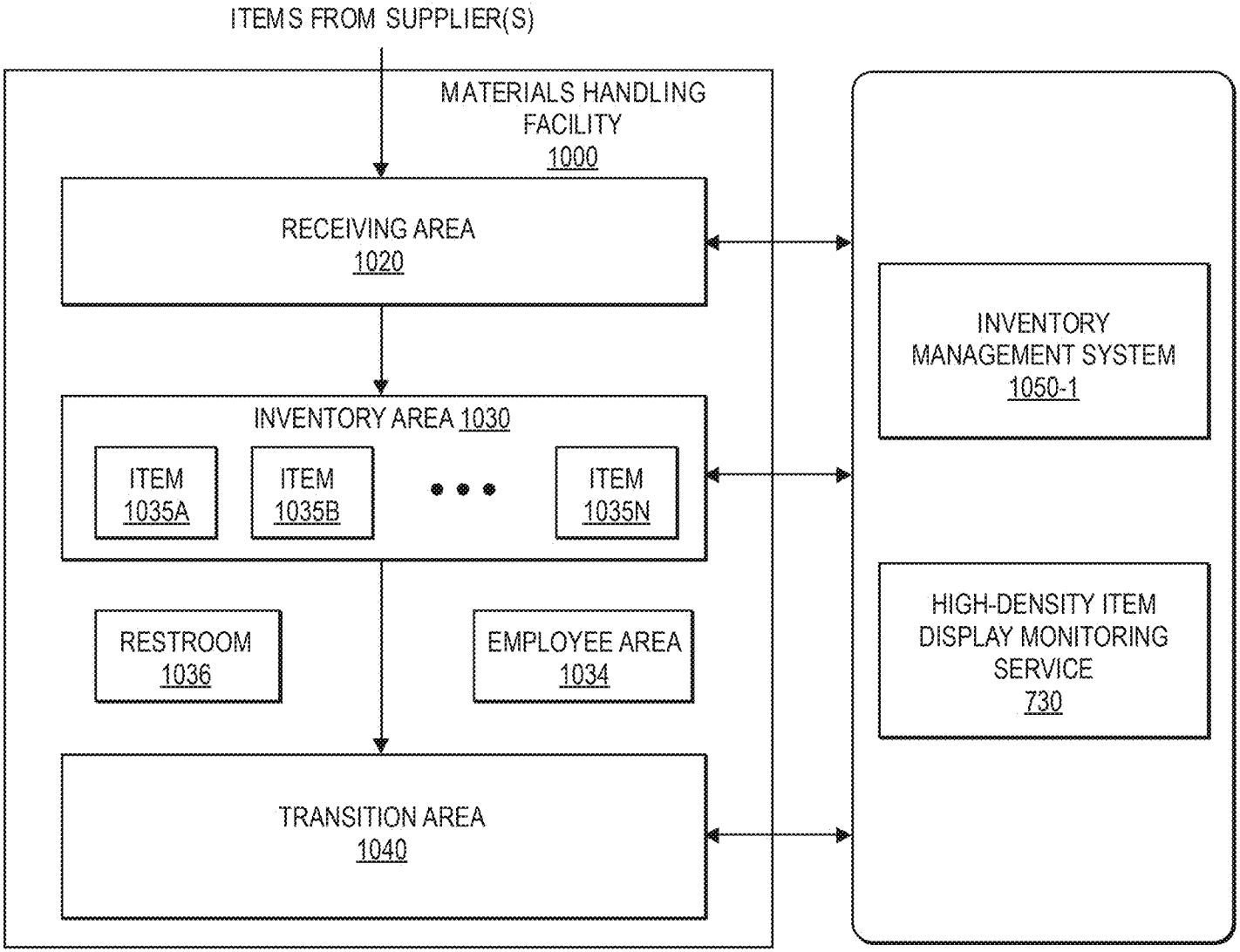
FIG. 10 is a block diagram illustrating a materials handling facility, in accordance with implementations of the present disclosure.

An implementation of a materials handling facility configured to store and manage inventory items is illustrated in FIG. 10. As shown, a materials handling facility 1000 includes a receiving area 1020, an inventory area 1030 configured to store an arbitrary number of inventory items 1035A, 1035B, through 1035N, one or more transition areas 1040, one or more restrooms 1036, and one or more employee areas 1034 or breakrooms. The arrangement of the various areas within materials handling facility 1000 is depicted functionally rather than schematically. For example, in some implementations, multiple different receiving areas 1020, inventory areas 1030 and transition areas 1040 may be interspersed rather than segregated. Additionally, the materials handling facility 1000 includes an inventory management system 1050-1 configured to interact with each of receiving area 1020, inventory area 1030, transition area 1040 and/or agents within the materials handling facility 1000. Likewise, the materials handling facility may also include a high-density item display monitoring service 730, as discussed herein.

The materials handling facility 1000 may be configured to receive different kinds of inventory items 1035 from various suppliers and to store them until an agent orders or retrieves one or more of the items. The general flow of items through the materials handling facility 1000 is indicated using arrows. Specifically, as illustrated in this example, items 1035 may be received from one or more suppliers, such as manufacturers, distributors, wholesalers, etc., at receiving area 1020. In various implementations, items 1035 may include merchandise, commodities, perishables, or any suitable type of item depending on the nature of the enterprise that operates the materials handling facility 1000.

Upon being received from a supplier at receiving area 1020, items 1035 may be prepared for storage. For example, in some implementations, items 1035 may be unpacked or otherwise rearranged and the inventory management system 1050-1 (which, as described herein, may include one or more software applications executing on a computer system) may be updated to reflect the type, quantity, condition, cost, weight, location or any other suitable parameters with respect to newly received items 1035. It is noted the items 1035 may be stocked, managed or dispensed in terms of countable, individual units or multiples of units, such as packages, cartons, crates, pallets or other suitable aggregations. Alternatively, some items 1035, such as bulk products, commodities, etc., may be stored in continuous or arbitrarily divisible amounts that may not be inherently organized into countable units. Such items 1035 may be managed in terms of measurable quantities such as units of length, area, volume, weight, time duration or other dimensional properties characterized by units of measurement. Generally speaking, a quantity of an item 1035 may refer to either a countable number of individual or aggregate units of an item 1035 or a measurable amount of an item 1035, as appropriate.

After arriving through receiving area 1020, items 1035 may be stored within inventory area 1030 on an inventory shelf. In some implementations, like items 1035 may be stored or displayed together in bins, on shelves, such as the high-density item display apparatus discussed herein, and/or via other suitable storage mechanisms, such that all items 1035 of a given kind are stored in one location. In other implementations, like items 1035 may be stored in different locations. For example, to optimize retrieval of certain items 1035 having high turnover or velocity within a large physical facility, those items 1035 may be stored in several different locations and/or on several different high-density item display apparatuses to reduce congestion that might occur at a single point of storage.

When an order specifying one or more items 1035 is received, or as an agent progresses through the materials handling facility 1000, the corresponding items 1035 may be selected or "picked" from the inventory area 1030. For example, in one implementation, an agent may have a list of items to pick and may progress through the materials handling facility picking items 1035 from the inventory area 1030. In other implementations, materials handling facility employees (referred to herein as agents) may pick items 1035 using written or electronic pick lists derived from orders. In some instances, an item may need to be repositioned from one location within the inventory area 1030 to another location. For example, in some instances, an item may be picked from its inventory location, moved a distance and placed at another location.

As discussed, as the agent moves through the materials handling facility, images of the agent may be obtained and processed by the management system 1050-1 to maintain a tracklet corresponding to the agent, a tracklet score may also be determined indicating a confidence that the position of the agent is known, and/or to re-identify agents.

Figure 11:
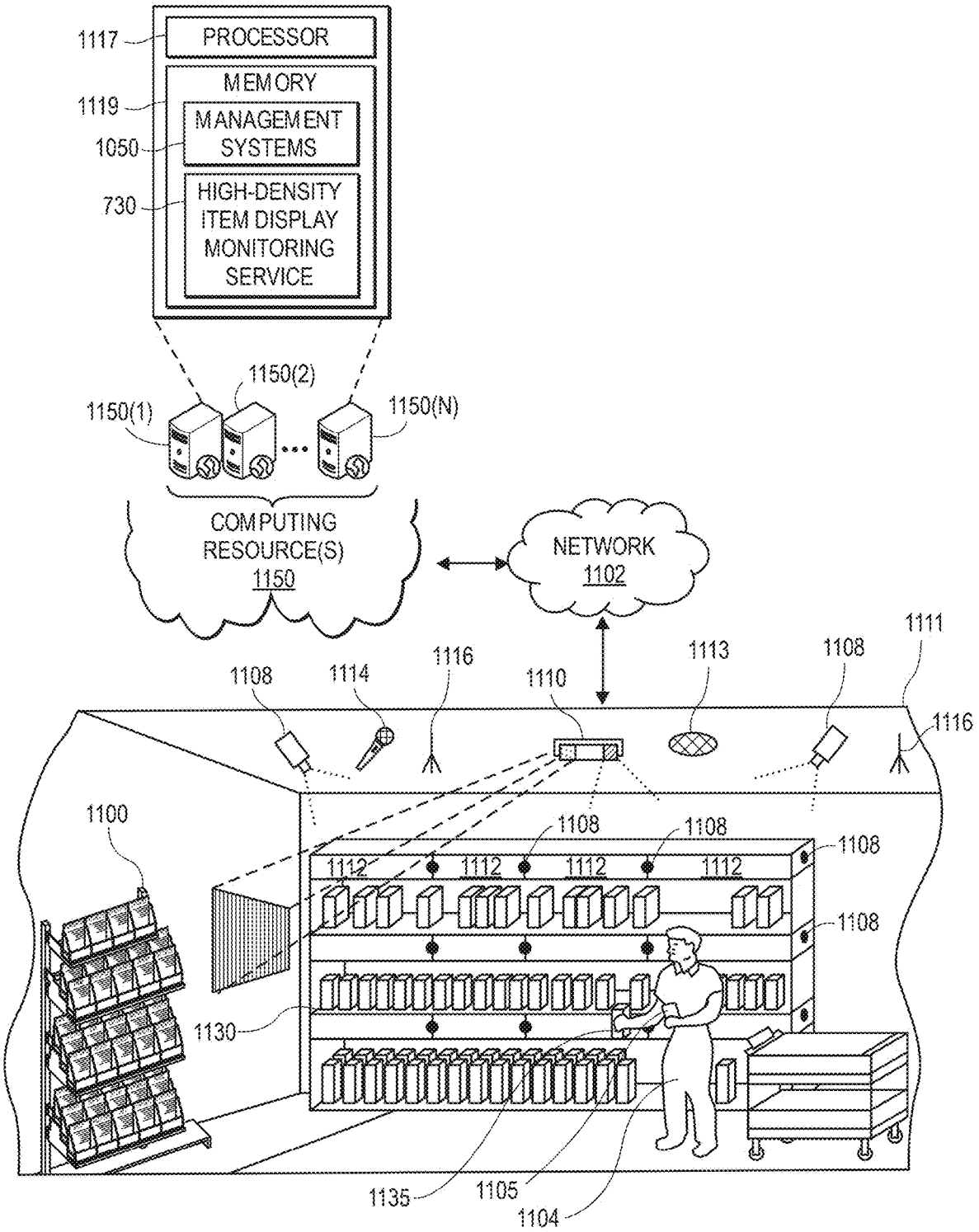
FIG. 11 shows additional components of the materials handling facility of FIG. 10, in accordance with implementations of the present disclosure.

FIG. 11 shows additional components of a materials handling facility 1111, according to one implementation. Generally, the materials handling facility 1111 may include one or more image capture devices, such as cameras 1108. For example, one or more cameras 1108 may be positioned in locations of the materials handling facility 1111 so that images of locations, items, and/or agents within the materials handling facility can be captured. In some implementations, the image capture devices 1108 may be positioned overhead, such as on the ceiling, and oriented toward a surface (e.g., floor) of the material handling facility so that the image capture devices 1108 are approximately perpendicular with the surface and the field of view is oriented toward the surface. The overhead image capture devices may then be used to capture images of agents and/or locations within the materials handling facility from an overhead view. In addition, in some implementations, one or more cameras 1108 may be positioned on or inside of inventory areas. For example, a series of cameras 1108 may be positioned on external portions of the inventory areas and positioned to capture images of agents and/or the location surrounding the inventory area.

In addition to cameras 1108, other input devices, such as pressure sensors, infrared sensors, scales, light curtains, load cells, RFID readers, etc., may be utilized with the implementations described herein. For example, a pressure sensor, load cell, and/or a scale may be used to detect the presence or absence of items and/or to determine when an item is added and/or removed from inventory areas. Likewise, a light curtain may be virtually positioned to cover the front of an inventory area and detect when an object (e.g., an agent's hand) passes into or out of the inventory area. The light curtain may also include a reader, such as an RFID reader, that can detect a tag included on an item as the item passes into or out of the inventory location. For example, if the item includes an RFID tag, an RFID reader may detect the RFID tag as the item passes into or out of the inventory location. Alternatively, or in addition thereto, the inventory shelf may include one or more antenna elements coupled to an RFID reader that are configured to read RFID tags of items located on the inventory shelf.

When an agent 1104 arrives at the materials handling facility 1111, one or more images of the agent 1104 may be captured and processed. For example, the images of the agent 1104 may be processed to identify the agent and/or generate a feature set that includes embedding vectors representative of the agent. In some implementations, rather than or in addition to processing images to identify the agent 1104, other techniques may be utilized to identify the agent. For example, the agent may provide an identification (e.g., agent name, password), the agent may present an identifier (e.g., identification badge, card), an RFID tag in the possession of the agent may be detected, a visual tag (e.g., barcode, bokode, watermark) in the possession of the agent may be detected, biometrics may be utilized to identify the agent, a smart phone or other device associated with the agent may be detected and/or scanned, etc.

For example, an agent 1104 located in the materials handling facility 1111 may possess a portable device 1105 that is used to identify the agent 1104 when they enter the materials handling facility 1111 and/or to provide information about items located within the materials handling facility 1111, receive confirmation that the inventory management system 1050-1 has correctly identified items that are picked and/or placed by the agent, receive requests for confirmation regarding one or more event aspects, etc. Generally, the portable device 1105 has at least a wireless module to facilitate communication with the management systems 1050 (e.g., the inventory management system) and a display (e.g., a touch based display) to facilitate visible presentation to and interaction with the agent 1104. The portable device 1105 may store a unique identifier and provide that unique identifier to the management systems 1050 and be used to identify the agent 1104. In some instances, the portable device 1105 may also have other features, such as audio input/output (e.g., speaker(s), microphone(s)), video input/output (camera(s), projector(s)), haptics (e.g., keyboard, keypad, touch screen, joystick, control buttons) and/or other components.

In some instances, the portable device 1105 may operate in conjunction with or may otherwise utilize or communicate with one or more components of the management systems 1050. Likewise, components of the management systems 1050 may interact and communicate with the portable device 1105 as well as identify the agent 1104, communicate with the agent 1104 via other means and/or communicate with other components of the management systems 1050.

Generally, the management systems 1050 may include one or more input/output devices, such as imaging devices (e.g., cameras) 1108, projectors 1110, displays 1112, speakers 1113, microphones 1114, multiple-camera apparatus, illumination elements (e.g., lights), etc., to facilitate communication between the management systems 1050 and/or the agent 1104 and detection of items, events and/or other actions within the materials handling facility 1111. In some implementations, multiple input/output devices may be distributed within the materials handling facility 1111. For example, there may be multiple imaging devices, such as cameras 1108 located on the ceilings and/or cameras 1108 (such as pico-cameras) located in the aisles near the inventory items.

The facility 1111 may also include one or more high-density item display apparatuses 1100, as discussed herein, that may maintain inventory of a variety of item types. As discussed, the high-density item display monitoring service 730, which may execute on the computing resources 1150 and/or on a computing resource 1150 included in the high-density item display apparatus 1100, may monitor load cells of each high-density item display apparatus 1100 and determine when items are picked and/or placed to bins of the high-density item display apparatus 1100.

Likewise, the management systems 1050 may also include one or more communication devices, such as wireless antennas 1116, which facilitate wireless communication (e.g., Wi-Fi®, Near Field Communication (NFC), Bluetooth®) between the management systems 1050 and other components or devices. The management systems 1050 may also include one or more computing resource(s) 1150, such as a server system, that may be local to the environment (e.g., materials handling facility), remote from the environment, or any combination thereof.

The management systems 1050 may utilize antennas 1116 within the materials handling facility 1111 to create a network 1102 (e.g., Wi-Fi®) so that the components and devices can connect to and communicate with the management systems 1050. For example, when the agent 1104 picks an item 1135 from an inventory area 1130, a camera 1108 of the multiple-camera apparatus may detect the removal of the item 1135 and the management systems 1050 may receive information, such as image data of the performed action (item pick from the inventory area), identifying that an item has been picked from the inventory area 1130. The event aspects (e.g., agent identity, action performed, item involved in the event) may then be determined by the management systems 1050. As another example, when an item is picked from a bin of a high-density item display apparatus 1100 the high-density item display monitoring service 730 may determine the item(s) picked and provide the item pick information to the management system 1050. The management system 1050 may utilize the item pick information received from the high-density item display management service 730 and known agent position information to associate the item pick and the identified item(s) with the agent 1104 that picked the item(s) from the high-density item display apparatus 1100.

Figure 12:
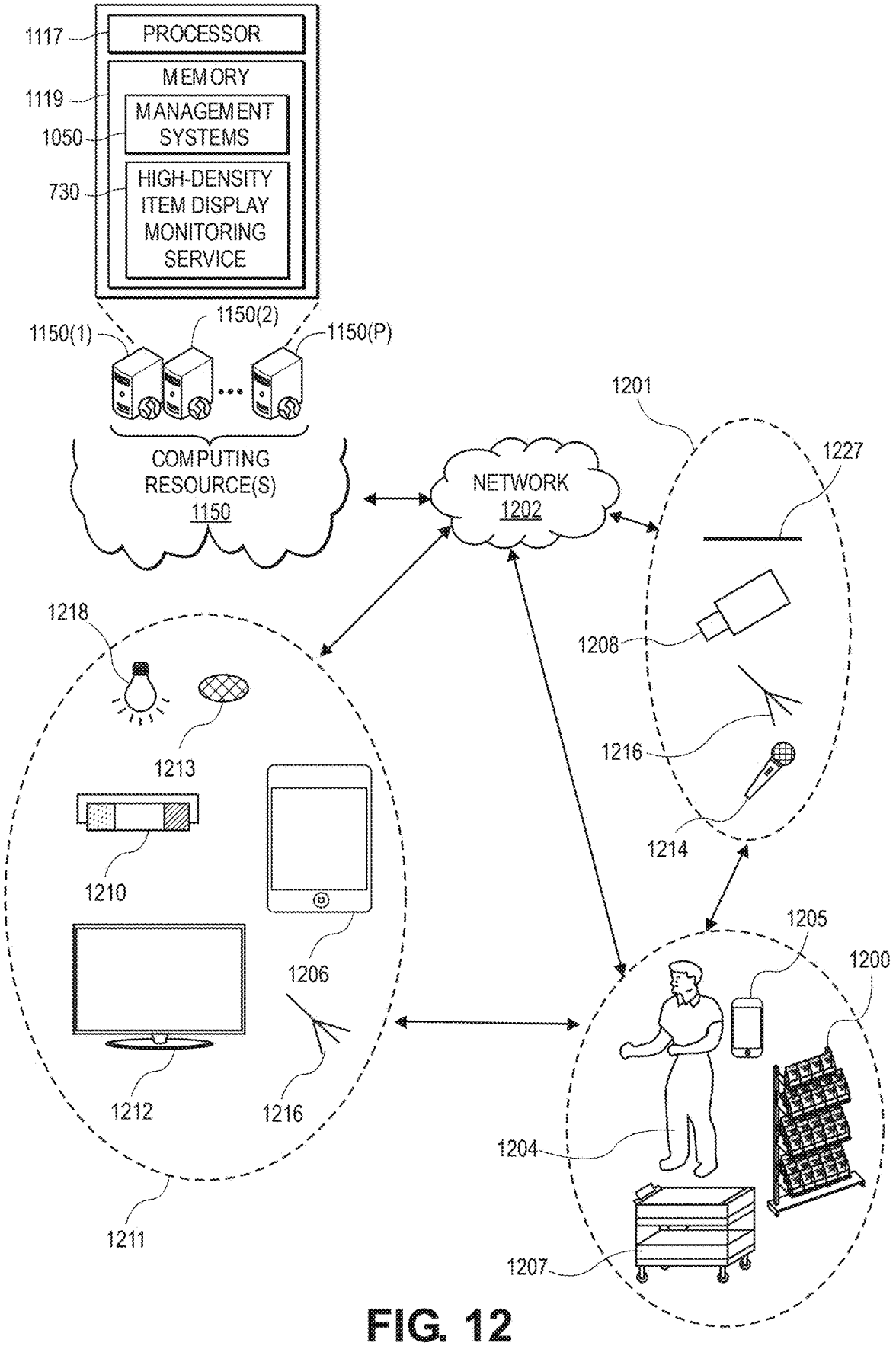
FIG. 12 shows components and communication paths between component types utilized in a materials handling facility of FIG. 10, in accordance with implementations of the present disclosure.

FIG. 12 shows example components and communication paths between component types utilized in a materials handling facility 1000, in accordance with one implementation. A portable device 1205 may communicate and interact with various components of management systems 1050 over a variety of communication paths. Generally, the management systems 1050 may include input components 1201, output components 1211 and computing resource(s) 1150. The input components 1201 may include an imaging device 1208, a multiple-camera apparatus 1227, microphone 1214, antenna 1216, or any other component that is capable of receiving input about the surrounding environment and/or from the agent 1204. The output components 1211 may include a projector 1210, a portable device 1206, a display 1212, an antenna 1216, a radio, speakers 1213, illumination elements 1218 (e.g., lights), and/or any other component that is capable of providing output to the surrounding environment and/or the agent 1204.

The management systems 1050 may also include computing resource(s) 1150. The computing resource(s) 1150 may be local to the environment (e.g., materials handling facility), remote from the environment, or any combination thereof. Likewise, the computing resource(s) 1150 may be configured to communicate over a network 1202 with input components 1201, output components 1211 and/or directly with the portable device 1205, an agent 1204, a tote 1207, and/or one or more high-density item display apparatuses 1200.

As illustrated, the computing resource(s) 1150 may be remote from the environment and implemented as one or more servers 1150(1), 1150(2), . . . , 1150(P) and may, in some instances, form a portion of a network-accessible computing platform implemented as a computing infrastructure of processors, storage, software, data access, and so forth that is maintained and accessible by components/devices of the management systems 1050 and/or the portable device 1205 via a network 1202, such as an intranet (e.g., local area network), the Internet, etc. The server system 1150 may process images of an agent to identify the agent, process images of items to identify items, determine a location of items, determine a position of items, detect item picks/places from/to a high-density item display apparatus 1200. The server system(s) 1150 does not require end-user knowledge of the physical location and configuration of the system that delivers the services. Common expressions associated for these remote computing resource(s) 1150 include "on-demand computing," "software as a service (SaaS)," "platform computing," "network-accessible platform," "cloud services," "data centers," and so forth.

Each of the servers 1150(1)-(P) include a processor 1117 and memory 1119, which may store or otherwise have access to management systems 1050, which may include or provide image processing (e.g., for agent identification, expression identification, and/or item identification), inventory tracking, location determination, and/or store or otherwise have access to the high-density item display management service 730.

The network 1202 may utilize wired technologies (e.g., wires, USB, fiber optic cable, etc.), wireless technologies (e.g., radio frequency, infrared, NFC, cellular, satellite, Bluetooth®, etc.), or other connection technologies. The network 1202 is representative of any type of communication network, including data and/or voice network, and may be implemented using wired infrastructure (e.g., cable, CAT5®, fiber optic cable, etc.), a wireless infrastructure (e.g., RF, cellular, microwave, satellite, Bluetooth®, etc.), and/or other connection technologies.

Figure 13:
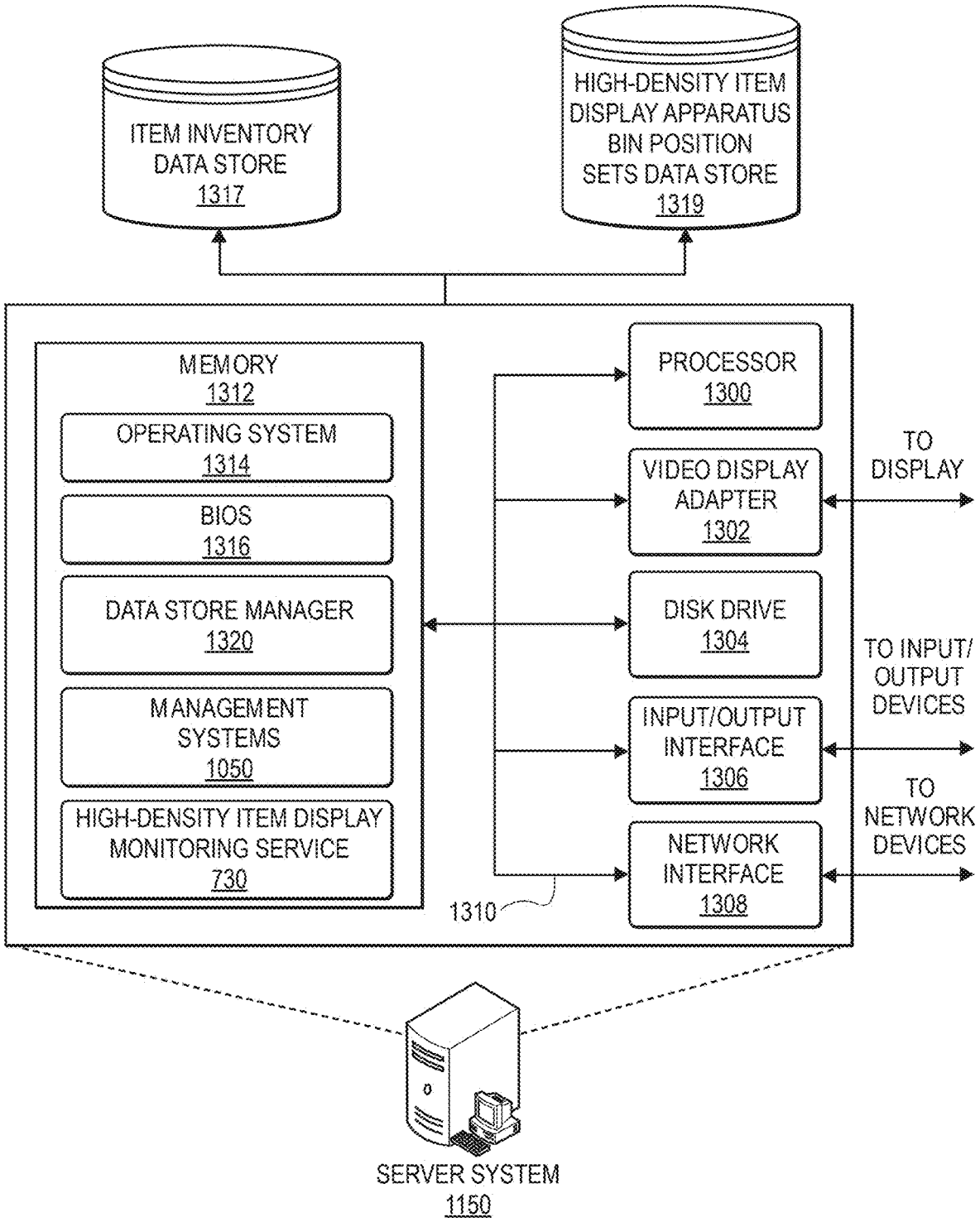
FIG. 13 is a block diagram of an illustrative implementation of a server system that may be used with various implementations.

FIG. 13 is a pictorial diagram of an illustrative implementation of a server system, such as the server system 1150 and/or the server system 721 that may be used in the implementations described herein. The server system illustrated in FIG. 13 or another similar server system may be configured to operate as the management systems 1050 (inventory management system) and/or the high-density item display monitoring service 730.

The server system 1150 may include a processor 1300, such as one or more redundant processors, a video display adapter 1302, a disk drive 1304, an input/output interface 1306, a network interface 1308, and a memory 1312. The processor 1300, the video display adapter 1302, the disk drive 1304, the input/output interface 1306, the network interface 1308, and the memory 1312 may be communicatively coupled to each other by a communication bus 1310.

The video display adapter 1302 provides display signals to a local display permitting an operator of the server system 1150 to monitor and configure operation of the server system 1150. The input/output interface 1306 likewise communicates with external input/output devices, such as a mouse, keyboard, scanner, or other input and output devices that can be operated by an operator of the server system 1150. The network interface 1308 includes hardware, software, or any combination thereof, to communicate with other computing devices. For example, the network interface 1308 may be configured to provide communications between the server system 1150 and other computing devices via the network 1202, as shown in FIG. 12, such as the high-density item display apparatus 730.

The memory 1312 may be a non-transitory computer readable storage medium configured to store executable instructions accessible by the processor(s) 1300. In various implementations, the non-transitory computer readable storage medium may be implemented using any suitable memory technology, such as static random access memory (SRAM), synchronous dynamic RAM (SDRAM), nonvolatile/Flash-type memory, or any other type of volatile or permanent memory. In the illustrated implementation, program instructions and data implementing desired functions, such as those described herein, are shown stored within the non-transitory computer readable storage medium. In other implementations, program instructions may be received, sent, or stored upon different types of computer-accessible media, such as non-transitory media, or on similar media separate from the non-transitory computer readable storage medium. Generally speaking, a non-transitory, computer readable storage medium may include storage media or memory media such as magnetic or optical media, e.g., disk or CD/DVD-ROM. Program instructions and data stored via a non-transitory computer readable medium may be transmitted by transmission media or signals such as electrical, electromagnetic, or digital signals, which may be conveyed via a communication medium such as a network and/or a wireless link, such as may be implemented via the network interface 1308.

The memory 1312 is shown storing an operating system 1314 for controlling the operation of the server system 1150. A binary input/output system (BIOS) 1316 for controlling the low-level operation of the server system 1150 is also stored in the memory 1312. The memory 1312 additionally stores computer executable instructions, that, when executed by the processor 1300 cause the processor to perform one or more of the processes discussed herein. The memory 1312 additionally stores program code and data for providing network services. The data store manager application 1320 facilitates data exchange between the data stores 1317, 1319 and/or other data stores.

As used herein, the term "data store" refers to any device or combination of devices capable of storing, accessing and retrieving data which may include any combination and number of data servers, databases, data storage devices and data storage media in any standard, distributed or clustered environment. The server system 1150 can include any appropriate hardware and software for integrating with the data stores 1317, 1319 as needed to execute aspects of the management systems 1050.

The data stores 1317, 1319 can include several separate data tables, databases or other data storage mechanisms and media for storing data relating to a particular aspect. For example, the data stores 1317, 1319 illustrated include mechanisms for maintaining item inventory (1317) and high-density item display apparatus bin position information (1319) that indicates, for example, the item types associated with each bin of each high-density item display apparatus, the weight of items of each item type, the quantity of items of each item type stored in each bin, etc. Depending on the configuration and use of the server system 1150, one or more of the data stores 1317, 1319 may not be included or accessible to the server system 1150 and/or other data store may be included or accessible.

It should be understood that there can be many other aspects that may be stored in the data stores 1317, 1319. The data stores 1317, 1319 are operable, through logic associated therewith, to receive instructions from the server system 1150 and obtain, update or otherwise process data in response thereto.

The memory 1312 may also include the inventory management systems 1050, and/or the high-density item display monitoring service 730. The corresponding server system 1150 may be executable by the processor 1300 to implement one or more of the functions of the server system 1150. In one implementation, the server system 1150 may represent instructions embodied in one or more software programs stored in the memory 1312. In another implementation, the server system 1150 can represent hardware, software instructions, or a combination thereof.

The server system 1150, in one implementation, is a distributed environment utilizing several computer systems and components that are interconnected via communication links, using one or more computer networks or direct connections. It will be appreciated by those of ordinary skill in the art that such a system could operate equally well in a system having fewer or a greater number of components than are illustrated in FIG. 13. Thus, the depiction in FIG. 13 should be taken as being illustrative in nature and not limiting to the scope of the disclosure.

It should be understood that, unless otherwise explicitly or implicitly indicated herein, any of the features, characteristics, alternatives or modifications described regarding a particular implementation herein may also be applied, used, or incorporated with any other implementation described herein, and that the drawings and detailed description of the present disclosure are intended to cover all modifications, equivalents and alternatives to the various implementations as defined by the appended claims. Moreover, with respect to the one or more methods or processes of the present disclosure described herein, including but not limited to the flow charts shown in FIGS. 8 and 9 orders in which such methods or processes are presented are not intended to be construed as any limitation on the claimed inventions, and any number of the method or process steps or boxes described herein can be combined in any order and/or in parallel to implement the methods or processes described herein. Also, the drawings herein are not drawn to scale.

Conditional language, such as, among others, "can," "could," "might," or "may," unless specifically stated otherwise, or otherwise understood within the context as used, is generally intended to convey in a permissive manner that certain implementations could include, or have the potential to include, but do not mandate or require, certain features, elements and/or steps. In a similar manner, terms such as "include," "including" and "includes" are generally intended to mean "including, but not limited to." Thus, such conditional language is not generally intended to imply that features, elements and/or steps are in any way required for one or more implementations or that one or more implementations necessarily include logic for deciding, with or without user input or prompting, whether these features, elements and/or steps are included or are to be performed in any particular implementation.

The elements of a method, process, or algorithm described in connection with the implementations disclosed herein can be embodied directly in hardware, in a software module stored in one or more memory devices and executed by one or more processors, or in a combination of the two. A software module can reside in RAM, flash memory, ROM, EPROM, EEPROM, registers, a hard disk, a removable disk, a CD-ROM, a DVD-ROM or any other form of non-transitory computer-readable storage medium, media, or physical computer storage known in the art. An example storage medium can be coupled to the processor such that the processor can read information from, and write information to, the storage medium. In the alternative, the storage medium can be integral to the processor. The storage medium can be volatile or nonvolatile. The processor and the storage medium can reside in an ASIC. The ASIC can reside in a user terminal. In the alternative, the processor and the storage medium can reside as discrete components in a user terminal.

Disjunctive language such as the phrase "at least one of X, Y, or Z," or "at least one of X, Y and Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain implementations require at least one of X, at least one of Y, or at least one of Z to each be present.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C.

Language of degree used herein, such as the terms "about," "approximately," "generally," "nearly" or "substantially" as used herein, represent a value, amount, or characteristic close to the stated value, amount, or characteristic that still performs a desired function or achieves a desired result. For example, the terms "about," "approximately," "generally," "nearly" or "substantially" may refer to an amount that is within less than 10% of, within less than 5% of, within less than 1% of, within less than 0.1% of, and within less than 0.01% of the stated amount.

Although the invention has been described and illustrated with respect to illustrative implementations thereof, the foregoing and various other additions and omissions may be made therein and thereto without departing from the spirit and scope of the present disclosure.

What is claimed is:

1. A high-density item display apparatus, comprising:

a stepped structure having at least a first step and a second step;

a plurality of load cells, each load cell of the plurality of load cells operable to transmit a weight data generated by the load cell, the plurality of load cells, including:

a first plurality of load cells fixedly positioned along the first step; and a second plurality of load cells fixedly positioned along the second step;

a plurality of bin mounting components, each bin mounting component:

coupled with a load cell of the plurality of load cells; including a pocket; and operable to couple a bin to the high-density item display apparatus when a snap of a bin alignment component of the bin is received in the pocket of the bin mounting component such that the snap secures the bin to the bin mounting component;

a controller component communicatively coupled to each load cell of the plurality of load cells and operable to receive weight data from each load cell of the plurality of load cells; and a communication component communicatively coupled to the controller component and operable to transmit at least some of the weight data.

2. The high-density item display apparatus of claim 1, wherein:

each load cell of the plurality of load cells is individually identifiable and addressable by the controller component; and each load cell is further operable to transmit the weight data to the controller component.

3. The high-density item display apparatus of claim 1, further comprising:

a third step included in the stepped structure; and a third plurality of load cells included in the plurality of load cells fixedly positioned along the third step, wherein the third plurality of load cells has fewer load cells than the second plurality of load cells.

4. The high-density item display apparatus of claim 1, further comprising:

an antenna included with the communication component and operable to wirelessly transmit the weight data.

5. A system, comprising:

a high-density item display apparatus, including:

a first elongated surface;

a first load cell fixedly coupled to the first elongated surface and operable to transmit a first weight data generated by the first load cell;

a second elongated surface;

a second load cell fixedly coupled to the second elongated surface and operable to transmit a second weight data generated by the second load cell; and a first bin mounting component coupled with the first load cell, the first bin mounting component including a first pocket and operable to couple a first bin to the high-density item display apparatus when a first snap of a first bin alignment component of the first bin is received in the first pocket of the first bin mounting component such that the first bin is supported by the first bin mounting component and creates a one-to-one connection between the first bin and the first load cell;

a second bin mounting component coupled with the second load cell, the second bin mounting component including a second pocket and operable to couple a second bin to the high-density item display apparatus when a second snap of a second bin alignment component of the second bin is received in the second pocket of the second bin mounting component such that the second bin is supported by the second bin mounting component and creates a one-to-one connection between the second bin and the second load cell;

the first bin, including:

a first base having a first top surface and a first bottom surface;

a first side coupled to the first base and positioned at a first angle with respect to the first top surface of the first base such that a first plurality of items of a first item type may be placed in the first bin and presented for display; and a first bin alignment component including the first snap, the first bin alignment component coupled to the first bottom surface of the first base or the first side and operable to mount with the first bin mounting component and secure the first bin to the high-density item display apparatus;

the second bin, including:

a second base having a second top surface and a second bottom surface;

a second side coupled to the second base and positioned at a second angle with respect to the second top surface of the second base such that a second plurality of items of a second item type may be placed in the second bin and presented for display; and a second bin alignment component including the second snap, the second bin alignment component coupled to the second bottom surface of the second base or the second side and operable to mount with the second bin mounting component and secure the second bin to the high-density item display apparatus; and a computing system, including:

one or more processors; and a memory storing program instructions that, when executed by the one or more processors, cause the one or more processors to at least:

maintain a first load cell identifier corresponding to the first load cell;

maintain a first item weight for items of the first item type associated with the first load cell or the first bin mounted to the first mounting component coupled with the first load cell;

receive the first weight data from the first load cell;

determine, based at least in part on the first weight data and the first item weight, that a first item of the first item type has been picked from the first bin; and in response to determination that the first item has been picked, send an item pick notification indicating at least the first item type.

6. The system of claim 5, wherein the high-density item display apparatus further includes:

a transmission component operable to transmit the first weight data from the high-density item display apparatus; and wherein the computing system is separate from the high-density item display apparatus and receives the transmission of the first weight data transmitted by the transmission component.

7. The system of claim 5, the high-density item display apparatus further including:

a third elongated surface;

a plurality of load cells fixedly positioned along the third elongated surface; and a plurality of bin mounting components, each bin mounting component of the plurality of bin mounting components:

coupled with one load cell of the plurality of load cells; and operable to couple a third bin of a plurality of bins to the high-density item display apparatus when a third bin alignment component of the third bin is mounted to a third bin mounting component such that the third bin is supported by the third bin mounting component and creates a one-to-one connection between the third bin and a third load cell to which the third bin mounting component is coupled.

8. The system of claim 5, wherein the second bin has at least one of a different size or a different shape than the first bin.

9. The system of claim 5, the high-density item display apparatus further including:

at least one bracket operable to secure the high-density item display apparatus to a surface.

10. The system of claim 9, wherein the surface is at least one of a gondola, a wall, a pole, a shelving unit, or a second high-density item display apparatus.

11. The system of claim 5, the high-density item display apparatus, further comprising:

a controller component coupled with each of the first load cell and the second load cell and operable to at least:

receive the first weight data from the first load cell;

receive the second weight data from the second load cell; and cause transmission of the first weight data and the second weight data to the computing system.

12. The system of claim 5, wherein the program instructions that, when executed by the one or more processors, further cause the one or more processors to at least:

receive the second weight data from the second load cell; and determine, based at least in part on the second weight data and a second item weight associated with at least one of the second load cell or the second bin, that an item place of a second item has occurred at the high-density item display apparatus.

13. The system of claim 12, wherein the program instructions that cause the one or more processors to determine that the item place of the second item has occurred, further include instructions that, when executed by the one or more processors, further cause the one or more processors to at least:

determine that a second weight indicated in the second weight data does not correspond to the second item weight; and in response to determination that the second weight does not correspond to the second item weight, send a second notification that the second item placed to the second bin does not correspond to the second item type associated with the second bin.

14. The system of claim 5, wherein the high-density item display apparatus further includes:

a power supply that supplies power to the first load cell and the second load cell.

15. An apparatus, comprising:

an elongated surface;

a plurality of load cells fixedly positioned along the elongated surface, each load cell of the plurality of load cells operable to transmit a weight data generated by the load cell;

a plurality of bin mounting components, each bin mounting component:

coupled with a load cell of the plurality of load cells; including a pocket; and operable to couple a bin to the apparatus when a snap of a bin alignment component of the bin is received in the pocket of the bin mounting component such that the snap secures the bin to the bin mounting component; and a controller component communicatively coupled to each load cell of the plurality of load cells and operable to receive weight data from each load cell of the plurality of load cells.

16. The apparatus of claim 15, further comprising:

a transmission component operable to transmit the weight data received by the controller component.

17. The apparatus of claim 15, further comprising:

a bin, including:

a base having a top surface and a bottom surface;

at least one side coupled to the base and positioned at an angle with respect to the top surface of the base such that a plurality of items of an item type may be placed in the bin and presented for display; and a bin alignment component coupled to at least one of the bottom surface of the base or the at least one side and operable to mount with a bin mounting component of the plurality of bin mounting components and secure the bin to the apparatus.

18. The apparatus of claim 15, wherein the controller component is further configured to at least:

determine, based at least on a first weight data received from a first load cell, a quantity of items of an item type associated with at least one of the first load cell or a first bin mounted to a bin mounting component coupled to the first load cell that were picked from the bin.

19. The apparatus of claim 15, further comprising:

at least one bracket operable to secure the apparatus to at least one of a wall, a pole, a shelving unit, a gondola, or a second apparatus.

20. The apparatus of claim 15, further comprising:

a power supply, wherein the power supply is at least one of a Power over Ethernet ("PoE"), an alternating current ("AC") power supply, a direct current ("DC") power supply, a Universal Serial Bus ("USB") power supply, a battery, or a solar power supply.

* * * * *